US010309071B2

(12) United States Patent
Krstulović-Opara et al.

(10) Patent No.: US 10,309,071 B2
(45) Date of Patent: Jun. 4, 2019

(54) FLOATABLE MODULAR PROTECTIVE HARBOR STRUCTURE AND METHOD OF SEASONAL SERVICE EXTENSION OF OFFSHORE VESSELS IN ICE-PRONE ENVIRONMENTS

(71) Applicants: Neven Krstulović-Opara, The Woodlands, TX (US); Raymond R. Foltz, Houston, TX (US)

(72) Inventors: Neven Krstulović-Opara, The Woodlands, TX (US); Raymond R. Foltz, Houston, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 0 days.

(21) Appl. No.: 15/724,538

(22) Filed: Oct. 4, 2017

(65) Prior Publication Data

US 2018/0171573 A1 Jun. 21, 2018

Related U.S. Application Data

(60) Provisional application No. 62/437,330, filed on Dec. 21, 2016.

(51) Int. Cl.

| | |
|---|---|
| ***E02B 17/00*** | (2006.01) |
| ***B63B 59/00*** | (2006.01) |
| ***E02B 1/00*** | (2006.01) |

(52) U.S. Cl.

CPC ..... *E02B 17/0021* (2013.01); *B63B 59/00* (2013.01); *E02B 1/00* (2013.01); *B63B 2211/06* (2013.01)

(58) Field of Classification Search

CPC ..... E02B 17/0021; E02B 17/025; E02B 17/0017; E02B 17/02; E02B 1/00;

(Continued)

(56) References Cited

U.S. PATENT DOCUMENTS 559,116 A * 4/1896 Baldwin ..... E02D 19/04 405/13
3,779,019 A * 12/1973 Pogonowski ..... E02B 17/0021 405/61

(Continued)

FOREIGN PATENT DOCUMENTS

CN 102296565 A 12/2011
CN 103786841 A 5/2014

(Continued)

*Primary Examiner* — Carib A Oquendo

(74) *Attorney, Agent, or Firm* — ExxonMobil Upstream Research Company Law Department

(57) ABSTRACT

Modular structure for protecting an offshore vessel in a body of water from forces of ice features comprising a protective harbor wall, a flotation support, a pile, and a telescoping connection. The telescoping connection is operatively coupled to the protective harbor wall and the flotation support and constructed and arranged to axially move the protective harbor wall between a retracted position and a raised position. The protective harbor wall is constructed and arranged to enclose a harbor space and to counteract the forces of ice features. The flotation support supports the protective harbor wall and is constructed and arranged to change net buoyancy of the modular protective structure to submerge the structure such that the flotation support is positioned on a seabed. The pile is constructed and arranged to be partially disposed in the seabed to maintain the position of the flotation support on the seabed.

18 Claims, 24 Drawing Sheets

(58) Field of Classification Search
CPC ..... B63B 2211/06; B63B 59/00; B63B 35/08; B63B 35/83; B63B 35/86
See application file for complete search history.

(56) References Cited

U.S. PATENT DOCUMENTS

| | | | | |
|---|---|---|---|---|
| 3,958,426 | A | 5/1976 | Heien | |
| 4,069,642 | A | 1/1978 | Hendriks | |
| 4,102,144 | A * | 7/1978 | Anders | B63B 35/10 114/40 |
| 4,155,323 | A | 5/1979 | Finsterwalder | |
| 4,422,804 | A | 12/1983 | Gerwick, Jr. et al. | |
| 4,504,172 | A | 3/1985 | Clinton et al. | |
| 4,511,288 | A | 4/1985 | Wetmore | |
| 4,618,286 | A | 10/1986 | Michel et al. | |
| 4,666,341 | A * | 5/1987 | Field | B63B 35/10 114/40 |
| 4,701,075 | A | 10/1987 | Martyshenko et al. | |
| 4,884,918 | A * | 12/1989 | Gulbenkian | E02B 3/06 114/266 |
| 4,963,058 | A * | 10/1990 | Broughton | E02B 17/0017 405/14 |
| 4,984,935 | A | 1/1991 | de Oliveira Filho et al. | |
| 5,088,858 | A * | 2/1992 | Massoudi | E02B 17/0021 405/196 |
| 5,292,207 | A | 3/1994 | Scott | |
| 6,244,785 | B1 * | 6/2001 | Richter | B63B 3/04 114/125 |
| 6,340,272 | B1 * | 1/2002 | Runge | B63B 9/065 114/256 |
| 6,371,695 | B1 * | 4/2002 | Davenport, III | E02B 17/00 405/203 |
| 8,641,327 | B2 | 2/2014 | Krehbiel et al. | |
| 8,684,630 | B2 | 4/2014 | Mahmoud | |
| 2005/0139595 | A1 * | 6/2005 | Pepin-Lehalleur | B63B 9/065 220/4.13 |
| 2015/0353169 | A1 * | 12/2015 | Lawes | B63B 35/08 405/84 |
| 2018/0170487 | A1 * | 6/2018 | Hallai | B63B 9/065 |

FOREIGN PATENT DOCUMENTS

| | | |
|---|---|---|
| WO | WO 2010/024685 A1 | 3/2010 |
| WO | WO 2013/044978 A1 | 4/2013 |

* cited by examiner

FLOATABLE MODULAR PROTECTIVE HARBOR STRUCTURE AND METHOD OF SEASONAL SERVICE EXTENSION OF OFFSHORE VESSELS IN ICE-PRONE ENVIRONMENTS

CROSS REFERENCE TO RELATED APPLICATION

This application claims the benefit of U.S. Provisional Application Ser. No. 62/437,330, filed Dec. 21, 2016, entitled "Floatable Modular Protective Harbor Structure and Method of Seasonal Service Extension of Offshore Vessels in Ice-Prone Environments," the disclosure of which is incorporated herein by reference in its entirety.

FIELD

The present disclosure relates generally to methods and structures for protecting offshore vessels, and more particularly to methods and structures of protecting non-ice capable, offshore vessels from mobile ice and ice formations of Arctic, sub-Arctic, or other ice-prone offshore environments.

BACKGROUND

In recent years, exploration and production of hydrocarbons has extended such operations to Arctic, sub-Arctic, and other ice-prone offshore environments where large bodies of moving ice are found. These large moving bodies of ice can severely damage offshore exploration, development, or production vessels, such as offshore drilling units ("MODU"), platform vessels, or jackups.

An example of such an area is off the north coast of Alaska in the Beaufort Sea. With the onset of winter, the sea water near the coastline begins to freeze over. The freeze over results in the formation of a relatively smooth and continuous sheet of ice called "fast ice" which extends seaward from the shore to points which lie over water approximately 60 feet deep. The name fast ice implies that this sheet of ice is held fast to the land and does not move. However, fast ice can be moved by natural forces, such as currents, tides, and temperature changes, with the rate of movement being generally dependent on the thickness of the ice.

When set in motion, fast ice poses a threat to offshore operations. When the ice comes into direct contact with an offshore drilling structure, such as a production platform, large forces can develop. These forces cause the ice sheet to break and pile up directly against the offshore structure, forming a rubble field. As the rubble field grows and continues to be pressed against the structure, the forces can increase until the structure is seriously damaged.

Although it is subject to movement, fast ice is relatively stable during the winter. However, the fast ice sheet breaks up during the summer, resulting in the formation of many individual floating bodies of ice which are free to move about under the influence of winds and currents. These moving bodies of ice pose another threat to offshore operations.

Seaward of the fast ice zone is pack ice. Unlike fast ice, pack ice is discontinuous, rugged, and highly mobile. As pack ice moves, local areas of tension and compression develop, causing the ice to break and pile up. As a result, open leads and pressure ridges are formed.

Pressure ridges form in areas of pack ice which experience large compressive forces. The ice breaks and piles up, concentrating large masses of ice into relatively small areas. Pressure ridges extend well above and below the surrounding ice, and some are so large that they are able to survive the summer and become multi-year ice features.

During the winter season, many pressure ridges are embedded in the pack ice and move along with it, threatening any structure in their path. During the summer, pressure ridges can be blown toward shore, where they threaten structures and vessels which lie in shallow waters.

Heretofore, strategies for Arctic exploration, development, and production have included the construction of new-build, ice capable vessels and the reinforcement of existing vessels to make them ice capable. However, these approaches may impose prohibitively high costs and/or prohibitively long timelines that are inconsistent with the desire for quick deployment in Arctic exploration, development, or production operations during times of favorable business environments.

SUMMARY

The disclosure herein provides an alternative to the aforementioned prior strategies and uses a non-ice capable vessel in combination with an ice-protective floatable "harbor," which avoids a need for vessel strengthening and also accommodates use of any widely available non-ice capable vessels by separating the ice-resistance function from the exploration development, and/or production activities of the vessel.

In an embodiment, the vessel would be operated as in environments that are not ice-prone, and the floatable modular protective structure is used to create a protective harbor space. The floatable modular protective structures may include modular protective walls constructed from simple, low-cost modular (precast concrete or metal) units positioned to create the protective "harbor" for non-ice capable vessels used in the exploration, development, and/or production of hydrocarbons (particularly, oil and/or gas). The walls may be constructed by using modular concrete elements, such as blocks or panels, and/or modular metal elements, such as blocks or panels, that are mated together and operatively coupled together. Alternatively, the protective harbor wall may be a precast tank construction technology in combination with the flotation support. It is understood that embodiments described herein with respect to modular protective harbor walls may alternatively utilize a unitary protective harbor wall. It is also understood that embodiments described herein with respect to the protective harbor walls also may be utilized for the guide walls, for example the guide walls may be a modular construction or a single, unitary construction.

Similarly, the floatable modular protective structures may include modular flotation supports. The modular flotation support may include a plurality of discrete flotation elements operatively coupled together to support the protective harbor wall. Alternatively, the flotation support may be a single, unitary structure instead of a modular construction. The unitary flotation support structure may be cast in place.

Presently, onshore tank sizes of up to 40 meters (m) in height and 80 m in diameter are constructed on shore, which are designed to resist extreme events, such as an impact from a commercial airplane.

In an embodiment, the present disclosure provides a modular structure for protecting an offshore vessel in a body of water from forces of ice features in the body of water. The modular protective structure includes a protective harbor wall constructed and arranged to enclose a harbor space and to counteract the forces of ice features in the body of water. The harbor space is sized to receive the offshore vessel. The protective harbor wall is supported upon a flotation support. The flotation support may be moved to the location of a prospective offshore site of operations and submerged in anticipation of the offshore vessel float-in. Upon the flotation support settling upon the seabed, a pile is disposed into the seabed to maintain the position of the flotation support and enhance stability of the modular protective structure. In its submerged condition, the flotation support functions as a bottom founded structure while submerged. The protective harbor wall is raised by operation of a telescoping connection between the protective harbor wall and the submerged flotation support such that at least a portion of the protective harbor wall is extended above the surface, thereby establishing a protected harbor in which the offshore vessel may be moored. When operations are completed, the protective harbor wall may be re-submerged completely beneath the surface of the water by retraction of the telescoping connection to permit the vessel to be moved out of the harbor and/or carried away by an ice capable heavy lift vessel. Alternatively or in addition, the protective harbor wall may include a gate to facilitate the ingress or egress of the offshore vessel into or out of the harbor. The protective harbor wall may then be stowed or "winterized" by maintaining the protective harbor wall in a submerged, retracted condition during a remainder of the ice season.

An aspect of the present disclosure provides a modular structure for protecting an offshore vessel in a body of water from forces of ice features in the body of water. The modular protective structure comprising: a protective harbor wall, a flotation support, a pile, and a telescoping connection. The protective harbor wall is constructed and arranged to enclose a harbor space and to counteract the forces of ice features in the body of water. The harbor space is sized to receive the offshore vessel. The flotation support is constructed and arranged to support the protective harbor wall. The telescoping connection is operatively coupled to the protective harbor wall and the flotation support and is constructed and arranged to axially move the protective harbor wall between a retracted position and a raised position. The flotation support has capacity to float and support the protective harbor wall and to change net buoyancy of the modular protective structure to submerge the modular protective structure to a submerged position where the flotation support is positioned on a seabed in the body of water and where the protective harbor wall while in the retracted position is positioned entirely below a surface of the body of water and while in the raised position includes at least a portion of the protective harbor wall extending above the surface of the body of water to establish a harbor within which the offshore vessel is protected from the forces of ice features in the body of water. The pile is constructed and arranged to be partially disposed into the seabed to maintain the position of the flotation support on the seabed.

Also provided is a method for extending the service of an offshore vessel in a geographical region having a season of ice conditions. The method comprises establishing a harbor space protected from forces of ice features in a body of water at a location of operations, moving the offshore vessel into a position within the protective harbor wall proximate the location of operations, and extending operations of the offshore vessel in the season of ice conditions by maintaining the protective harbor wall in the raised position to protect the offshore vessel from ice features during the extended operations. The harbor space is established by: providing a modular protective structure at the location of operations, the modular protective structure comprising a flotation support, a protective harbor wall, a telescoping connection operatively coupled to the protective harbor wall and the flotation support, and a pile; submerging the modular protective structure to a submerged position where the flotation support is positioned on a seabed of the body of water and the entirety of the protective harbor wall while in a retracted position is positioned below a surface of the body of water; securing the flotation support to the seabed using the pile; and raising the protective harbor wall to a raised position using the telescoping connection while the flotation support remains secured to the seabed. At the raised position at least a portion of the protective harbor wall extends above the surface of the body of water to establish a harbor within which the offshore vessel is protected by the protective harbor wall from the forces of the ice features in the body of water. The protective harbor wall is constructed and arranged to enclose the harbor space, the harbor space being sized to receive the offshore vessel.

Another aspect of the present disclosure provides a method for preparing a site for operations in a region having periods of ice conditions. The method comprising: constructing a modular protective harbor wall; constructing a modular flotation support; operatively coupling the modular protective harbor wall and the modular flotation support using a telescoping connection to create a submersible modular protective harbor structure; and moving the submersible modular protective harbor structure to the site of operations. The modular protective harbor wall is constructed by operatively coupling a plurality of elements together to form an annulus. The modular flotation support is constructed by: constructing a plurality of modular flotation elements, launching the constructed modular flotation elements into a body of water, and operatively coupling together the launched plurality of modular flotation elements to form an annulus. The submersible modular protective harbor structure may be moved from a remote construction location to the site of operations.

Also provided is a submersible protective harbor structure for extending an operation in a region having periods of ice conditions, comprising: a modular protective harbor wall comprising a plurality of elements operatively coupled together in an open ended form; a flotation support comprising a plurality of flotation elements; and a telescoping connection between the modular protective harbor wall and the flotation support.

Still another aspect of the present disclosure provides a method for producing an additional margin of hydrocarbons annually from a site of operations having a season of ice conditions using a non-ice capable offshore vessel based upon the embodiments described herein.

The modular protective structure may have the capability to be repeatedly moved to and used at a plurality of offshore sites of operations. The protective harbor wall may also include a sloped outer wall portion in an orientation to break ice features by directing portions of the ice contacted by the sloped outer wall portion upwardly.

BRIEF DESCRIPTION OF THE DRAWINGS

While the present disclosure is susceptible to various modifications and alternative forms, specific exemplary implementations thereof have been shown in the drawings and are herein described in detail. It should be understood, however, that the description herein of specific exemplary implementations is not intended to limit the disclosure to the particular forms disclosed herein. This disclosure is to cover all modifications and equivalents as defined by the appended claims. It should also be understood that the drawings are not necessarily to scale, emphasis instead being placed upon clearly illustrating principles of exemplary embodiments of the present disclosure. Moreover, certain dimensions may be exaggerated to help visually convey such principles. Further where considered appropriate, reference numerals may be repeated among the drawings to indicate corresponding or analogous elements. Moreover, two or more blocks or elements depicted as distinct or separate in the drawings may be combined into a single functional block or element. Similarly, a single block or element illustrated in the drawings may be implemented as multiple steps or by multiple elements in cooperation.

DETAILED DESCRIPTION

Figure 1:
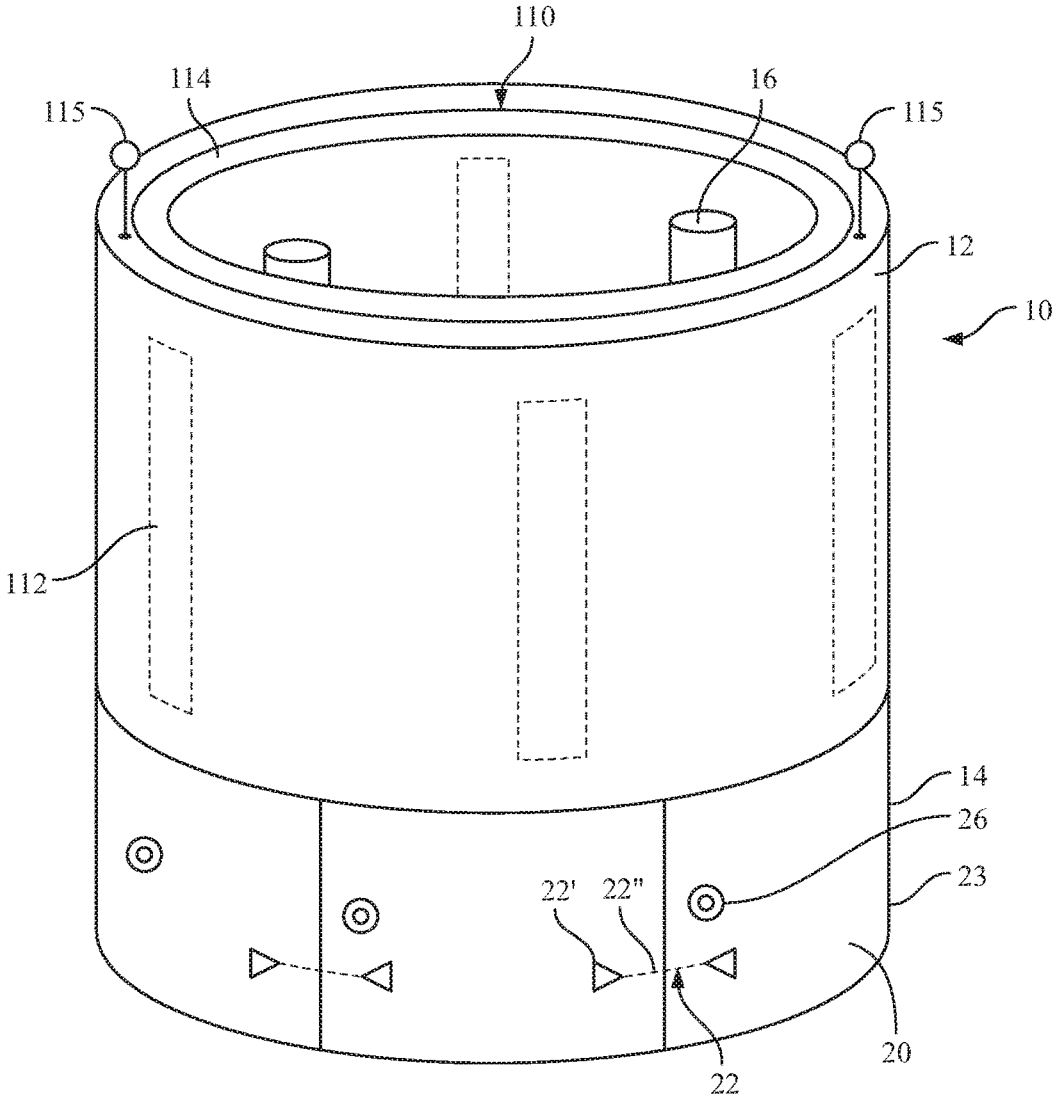
FIG. 1 is a perspective view of a protective harbor structure in accordance with an exemplary, axisymmetrical embodiment of the present disclosure.

The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than the broadest meaning understood by skilled artisans, such a special or clarifying definition will be expressly set forth in the specification in a definitional manner that provides the special or clarifying definition for the term or phrase.

For example, the following discussion contains a non-exhaustive list of definitions of several specific terms used in this disclosure (other terms may be defined or clarified in a definitional manner elsewhere herein). These definitions are intended to clarify the meanings of the terms used herein. It is believed that the terms are used in a manner consistent with their ordinary meaning, but the definitions are nonetheless specified here for clarity.

A/an: The articles "a" and "an" as used herein mean one or more when applied to any feature in embodiments and implementations of the present disclosure described in the specification and claims. The use of "a" and "an" does not limit the meaning to a single feature unless such a limit is specifically stated. The term "a" or "an" entity refers to one or more of that entity. As such, the terms "a" (or "an"), "one or more" and "at least one" can be used interchangeably herein.

And/or: The term "and/or" placed between a first entity and a second entity means one of (1) the first entity, (2) the second entity, and (3) the first entity and the second entity. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements). As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "only one of," or "exactly one of".

Any: The adjective "any" means one, some, or all indiscriminately of whatever quantity.

At least: As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements). The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

Comprising: In the claims, as well as in the specification, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

Couple: Any use of any form of the terms "connect", "engage", "couple", "attach", "join", or any other term describing an interaction between elements is not meant to limit the interaction to direct interaction between the elements and may also include indirect interaction between the elements described.

Embodiments: Reference throughout the specification to "one embodiment," "an embodiment," "some embodiments," "one aspect," "an aspect," "some aspects," "some implementations," "one implementation," "an implementation," or similar construction means that a particular component, feature, structure, method, or characteristic described in connection with the embodiment, aspect, or implementation may be combined with one or more other embodiments and/or implementations of the present disclosure. Thus, the appearance of the phrases "in one embodiment" or "in an embodiment" or "in some embodiments" (or "aspects" or "implementations") in various places throughout the specification are not necessarily all referring to the same embodiment and/or implementation. The particular features, structures, methods, or characteristics of one embodiment may be combined in any suitable manner with features, structures, methods, or characteristics of one or more other embodiments or implementations.

Exemplary: "Exemplary" is used exclusively herein to mean "serving as an example, instance, or illustration." Any embodiment described herein as "exemplary" is not necessarily to be construed as preferred or advantageous over other embodiments.

May: The word "may" is used throughout this application in a permissive sense (i.e., having the potential to, being able to), not a mandatory sense (i.e., must).

Operatively connected, attached, and/or coupled: Operatively connected, attached, and/or coupled means directly or indirectly connected features or elements.

Order of method steps: It should also be understood that, unless clearly indicated to the contrary, in any methods described herein that include more than one step or act, the order of the steps or acts of the method is not necessarily limited to the order in which the steps or acts of the method are recited.

Ranges: Concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a range of 1 to 200 should be interpreted to include not only the explicitly recited limits of 1 and 200, but also to include individual values such as 2, 3, 4, etc. and sub-ranges such as 10 to 50, 20 to 100, etc. Similarly, it should be understood that when numerical ranges are provided, such ranges are to be construed as providing literal support for claim limitations that only recite the lower value of the range as well as claims limitation that only recite the upper value of the range. For example, a disclosed numerical range of 10 to 100 provides literal support for a claim reciting "greater than 10" (with no upper bounds) and a claim reciting "less than 100" (with no lower bounds).

Reference will now be made to exemplary embodiments and implementations. Alterations and further modifications of the inventive features described herein and additional applications of the principles of the disclosure as described herein, such as would occur to one skilled in the relevant art having possession of this disclosure, are to be considered within the scope of the disclosure. Further, before particular embodiments of the present disclosure are disclosed and described, it is to be understood that this disclosure is not limited to the particular process and materials disclosed herein as such may vary to some degree. Moreover, in the event that a particular aspect or feature is described in connection with a particular embodiment, such aspects and features may be found and/or implemented with other embodiments of the present disclosure where appropriate. Specific language may be used herein to describe the exemplary embodiments and implementations. It will nevertheless be understood that such descriptions, which may be specific to one or more embodiments or implementations, are intended to be illustrative only and for the purpose of describing one or more exemplary embodiments. Accordingly, no limitation of the scope of the disclosure is thereby intended, as the scope of the present disclosure will be defined only by the appended claims and equivalents thereof.

Figure 2:
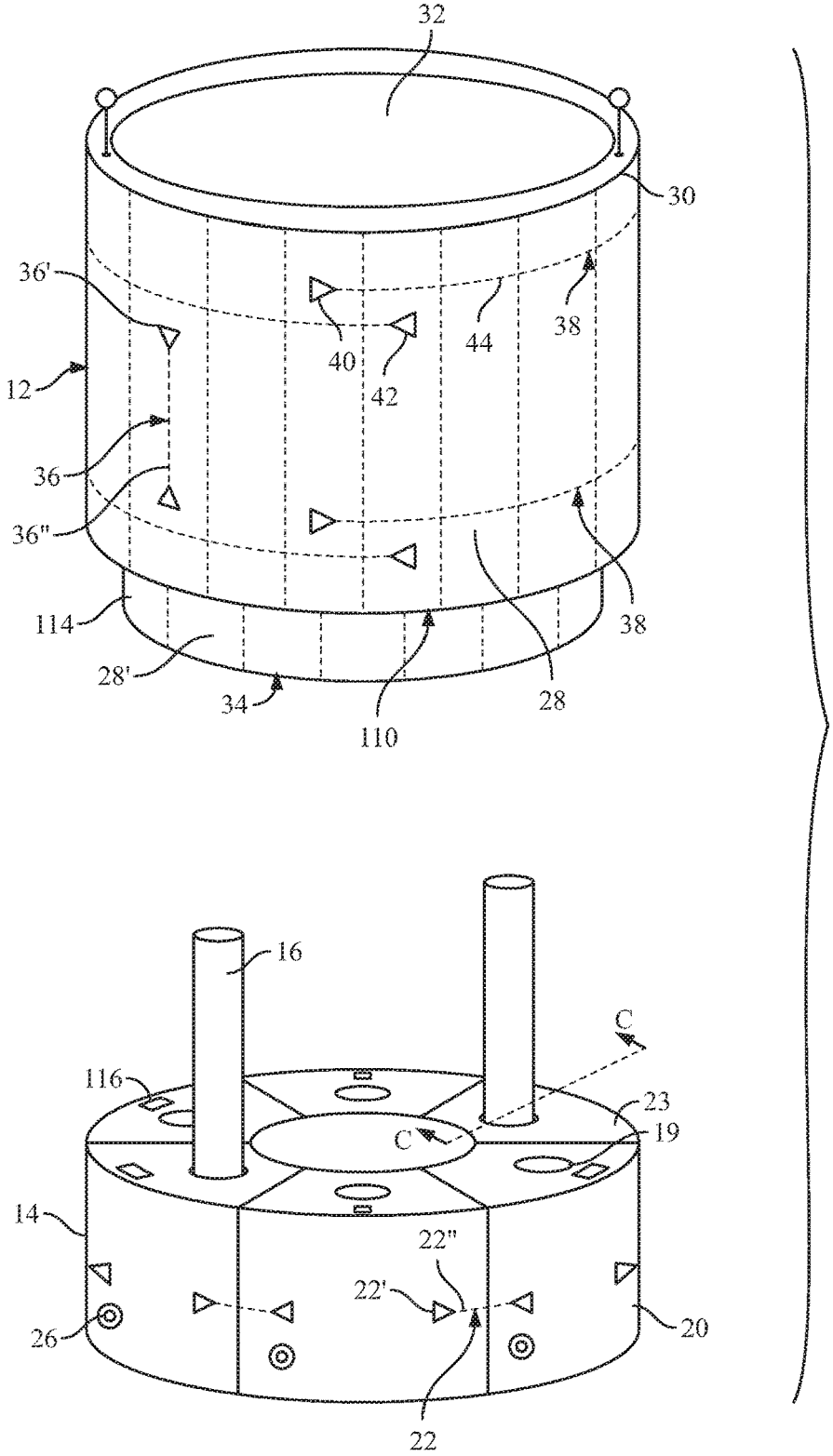
FIG. 2 is an exploded perspective view of the protective harbor structure of FIG. 1.

Referring now to FIGS. 1 and 2, the present disclosure provides a modular protective harbor structure 10 comprising a modular protective harbor wall 12 and a modular flotation support 14, which may be separately constructed and then combined together as shown in FIG. 1. The protective harbor structure 10 includes an anchorage (mooring) system comprising a plurality of vertically oriented piles 16 operatively coupled to the flotation support 14.

Figure 3A:
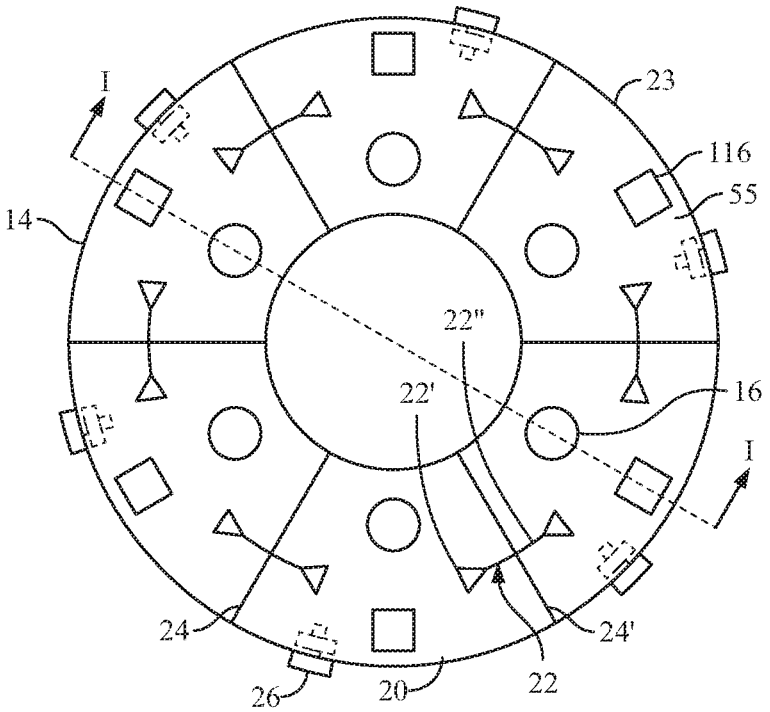
FIG. 3*a* is a top planar view of a modular flotation support of the protective harbor structure of FIG. 1.
Figure 3B:
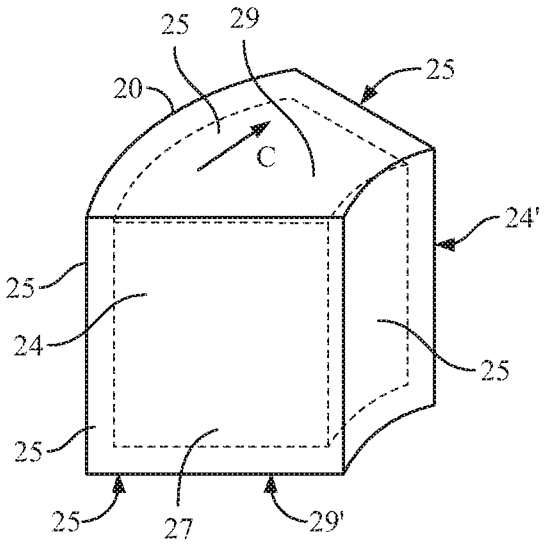
FIG. 3*b* is a perspective view of a discrete flotation element of the modular flotation support of FIG. 3*a*.

Referring now to FIGS. 2, 3*a* and 3*b*, in an embodiment, the modular flotation support 14 comprises a plurality of discrete, modular flotation elements 20 which are operatively coupled together at connectors 22 in an end to end relation to form an annulus 23. In the present embodiment, each modular flotation element 20 is generally arcuate and includes a hollow, walled structure having closed ends 24, 24' and a closed top 29 and bottom 29' such that the walls 25 of each modular flotation element 20 encloses an internal chamber 27 that serves as a ballast tank for the intake and removal (purging) of ballast, such as seawater, through an arrangement 26 including a ballast pump, a valve, and a conduit (not shown) to introduce or remove ballast from internal chamber 27. In the present embodiment, each modular flotation element 20 is provided with its own arrangement 26, but such may not be the case in other embodiments where only a selected few, but not all, of modular flotation elements 20 may be provided with an arrangement 26 or, a selected few, but not all, of the arrangements 26 are operated at any given time. The mechanical components of each arrangement 26 may be located within the confines of the respective modular flotation element 20 for protection against the environment. It is envisioned that in other embodiments, the flotation support 14 may be cast in place as one large unitary structure, instead of a modular construction.

In an embodiment, each modular flotation element 20 is constructed of concrete and the connectors 22 between the modular flotation elements 20 may comprise a plurality of (embedded) anchors 22' and tensioned tendons 22" of a plurality of post-cast tensioners, the number and placement of which may differ from those specifically depicted in FIGS. 2 and 3*a*. Alternatively, the connectors 22 may be other mechanical connectors, such as superposed, pinned brackets, hooks, and other forms of mechanical locks and connections. Alternatively, the connectors 22 may comprise a winding of tensioned wires around the circumference of the annulus 23, together with a protective coating, such as layer of concrete (shotcrete), that may be applied over (disposed on) the wire wrapping as a protective layer against the corrosive effects of seawater.

The annulus 23 of the flotation support may be any suitable diameter. In certain constructions, the annulus 23 of the flotation support may have a diameter of approximately 50 to 100 meters. The walls of the flotation elements of the flotation support may be any suitable thickness. In certain constructions, the walls of the flotation elements may have thicknesses of approximately 0.5 m of concrete. In other certain constructions, the walls of the flotation elements may be constructed of metal panels having a suitable thickness to support the protective harbor wall. The protective harbor wall may be any suitable thickness to counter the forces of the ice features. In some embodiments, the thickness of the walls of the flotation elements may be the same thickness as the protective harbor wall. In other embodiments, the thickness of the walls of the flotation elements may be a lesser thickness than the protective harbor wall or a greater thickness than the protective harbor wall.

In yet another embodiment, the ends 24, 24' of the modular flotation elements 20 may be open, such that upon operatively coupling the modular flotation elements 20 together, the internal chamber 27 is defined by and extends throughout several or all of the modular flotation elements 20. In such embodiments, the seams formed between adjacent modular flotation elements 20 are sealed in any suitable manner to prevent the ballast fluid within the internal chamber 27 from entering the surrounding body of water and the surrounding body of water from entering the internal chamber 27.

Figure 3E:
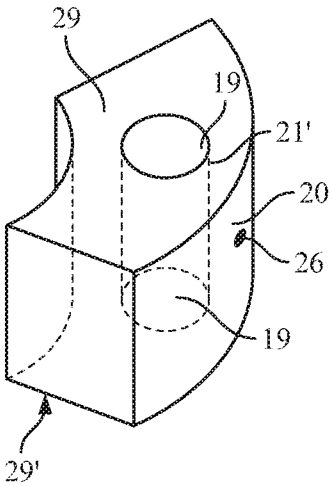
FIG. 3*e* is a perspective view of a discrete flotation element with an alternative arrangement for supporting a pile therein.
Figure 3D:
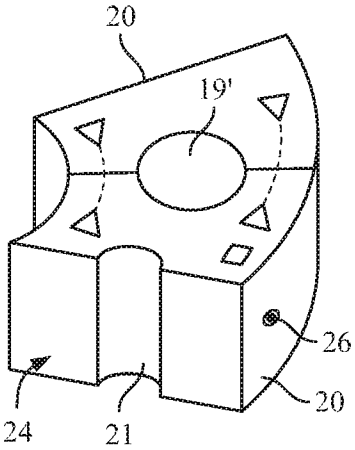
FIG. 3*d* is a perspective view of an adjacent pair of discrete flotation elements of the modular flotation support of FIG. 3*a*, but with an alternative arrangement for supporting a pile therebetween.
Figure 3C:
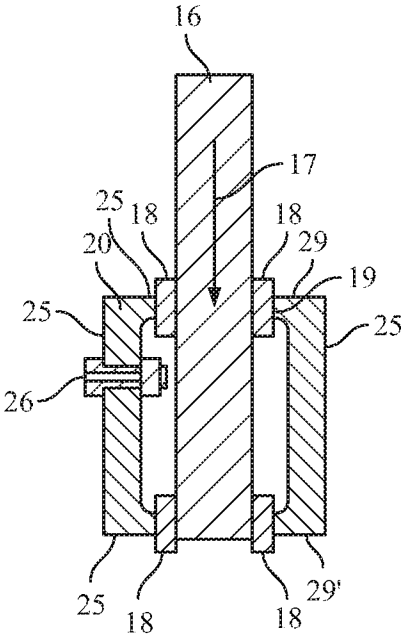
FIG. 3*c* is a cross sectional view of a discrete flotation element taken from the perspective of the double arrow C-C in FIG. 2.

Referring now to FIGS. 2 and 3*c*, the modular flotation support 14 further comprises a plurality of vertically oriented piles 16 that are disposed within openings 19 in the top 29 and bottom 29' of the modular flotation elements 20 at spaced locations about the modular flotation support 14. The piles 16 may comprise suction piles, driven piles, or any other suitable form of pile. The piles 16 are sized such that they may be disposed axially into the openings 19 of the modular flotation elements 20 in the direction of arrow 17 in FIG. 3*c* to extend partially through a bottom 29' of the modular flotation elements 20 to secure and stabilize the modular flotation support 14 upon a seabed. Seals 18 may be provided at the openings 19 positioned between the piles 16 and adjacent portions of the walls 25. Referring now to FIG. 3*d*, alternatively or in addition, the modular flotation elements 20 may be provided with channel recesses 21 at their end walls 24, 24' such that when adjacent modular flotation elements 20 are operatively coupled together an opening 19' is formed. Referring now to FIG. 3*e*, in an embodiment, the openings 19 may be defined by an internal, cylindrical channel wall 21' extending through the modular flotation element 20 from top 29 to bottom 29'. The internal, cylindrical channel wall 21' may be integrally formed during the casting process of the modular flotation element 20 or may be established with an insert. The shape of the channel recess 21 and channel wall 21' is to conform with the shape of the piles 16, which may not be necessarily cylindrical.

Figure 19:
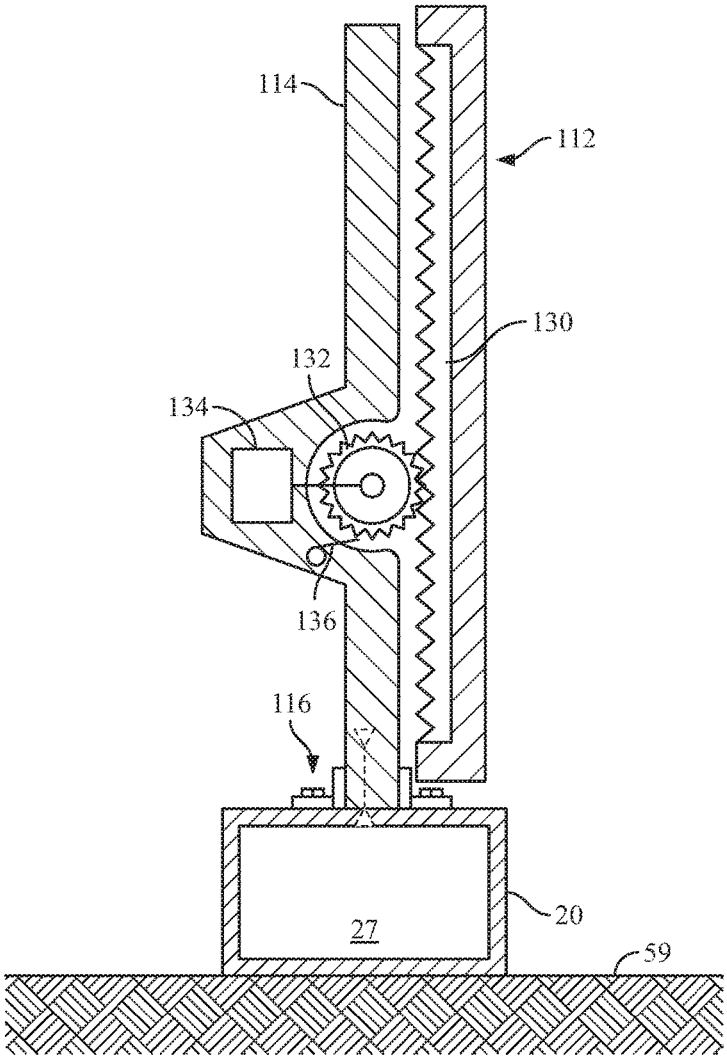
FIG. 19 is a cross-sectional representation of a rack and pinion unit of a telescopic connection suitable for use in the various embodiments of protective harbor structures disclosed herein.
Figure 20:
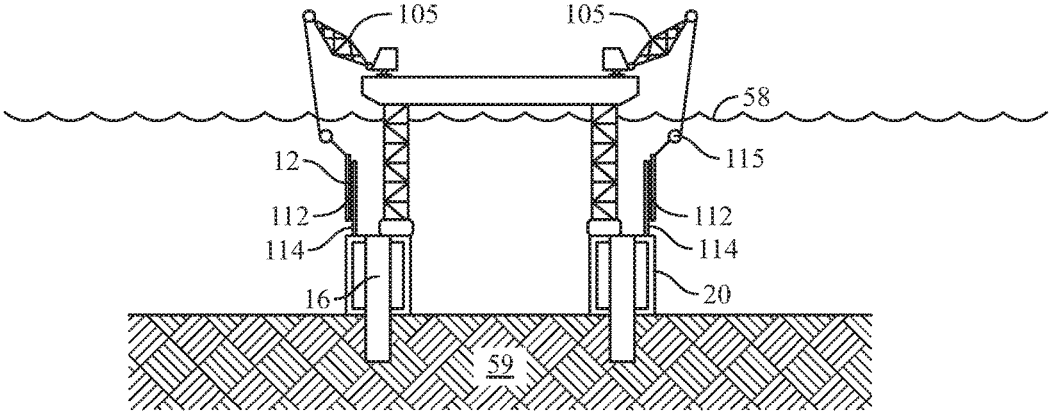
FIG. 20 is a representation of the modular protective harbor wall being connected to and raised by an external lift mechanism.

The protective harbor structure 10 further comprises a telescoping connection 110, which in the embodiment of FIG. 1 may comprise a guide structure of a guide wall 114 operatively coupled to the modular flotation support 14 and a plurality of axially (vertically) extending rack and pinion units 112 operatively coupling the guide wall 114 to the modular protective harbor wall 12. The rack and pinion units 112 guide, control and/or drive movement of the modular protective harbor wall 12 relative to modular flotation support 14. In some embodiments, the modular protective harbor wall 12 may be concentrically disposed radially exterior (outside) of the guide wall 114; whereas in other embodiments it may be concentrically disposed radially interior (inside) of the guide wall 114. In an embodiment, the rack and pinion unit 112 may be motorized, such as shown in FIG. 19, to raise the modular protective harbor wall 12 from a retracted (lowered) position, such as shown in FIG. 1, to a raised position, such as shown in FIG. 5*e*. In addition or alternatively to, the telescoping connection 110 may be operated through a link to an external drive, such as a plurality of hooks 115 provided atop the modular protective harbor wall 12, such that the modular protective harbor wall 12 may be raised and lowered by cranes 105 or other heavy lift equipment, such as shown in FIG. 20. In operation, such as shown in FIG. 19, the rack and pinion units 112 may provide a motorized drive to facilitate the raising and lowering of the modular protective harbor wall 12 or the rack and pinion units 112 may serve simply as a guide to maintain alignment of the modular protective harbor wall relative to the guide wall 114.

Figure 21A:
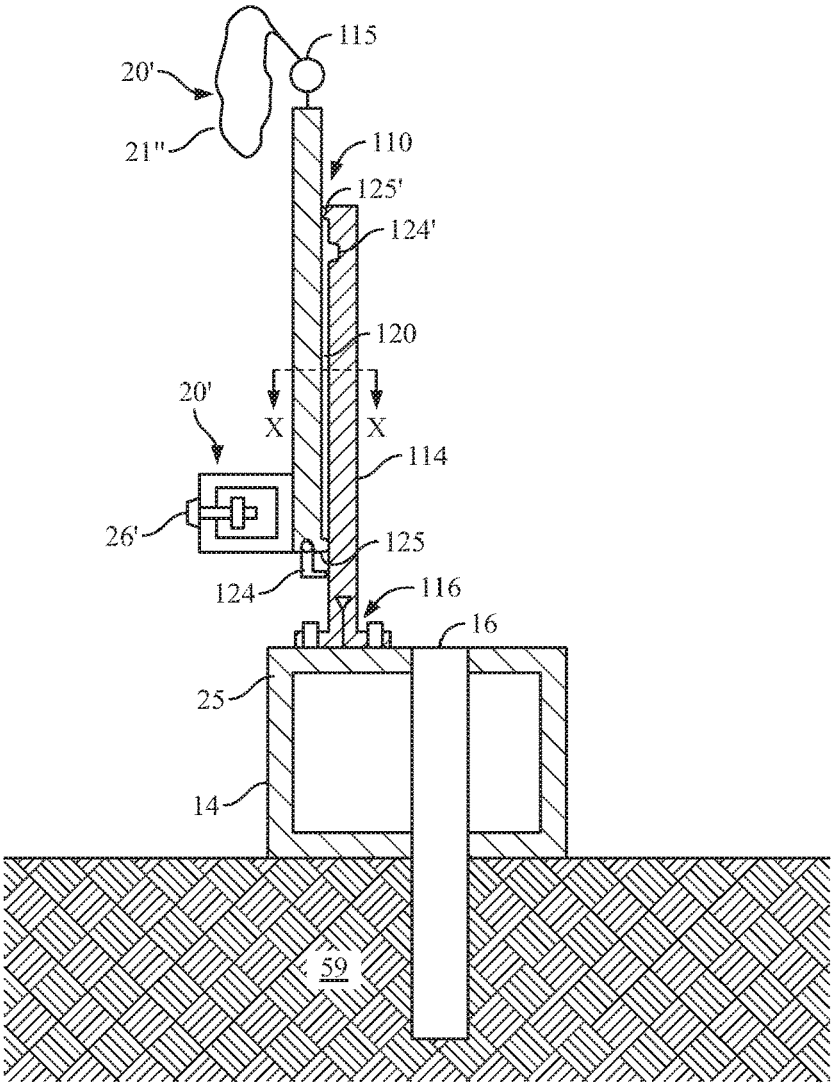
FIG. 21*a* is a detail view in cross section of various components that may comprise a telescopic connection suitable for use in the various embodiments of floatable protective harbor structures disclosed herein.

Referring now to FIG. 21*a*, the guide wall 114 may be operatively coupled to the modular flotation support 14 at a connection 116 that may comprise a series of post-cast tensioners or other mechanical connectors, such as bolts, brackets, and other various forms of mechanical connections. Suitable connections may be adapted from those used in the construction of land based tank structures, such as those proposed in U.S. Pat. No. 4,069,642, which is incorporated herein by reference in its entirety.

Figure 21B:
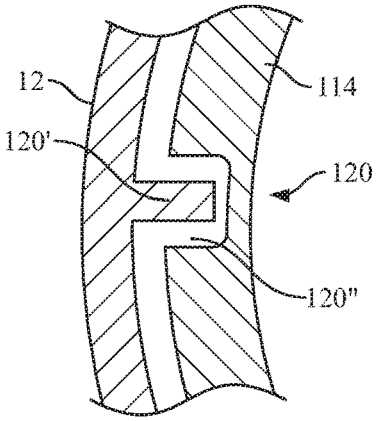
FIG. 21*b* is a cross-sectional detail taken from the perspective of double arrow X-X in FIG. 21*a*.

Referring to FIGS. 21*a* and 21*b*, the telescoping connection 110 may be supplemented with a plurality of vertically extending guides 120 wherein a tab 120' or a roller (not shown) may cooperate with a vertically extending groove 120" so as to maintain circumferential relation between the modular protective harbor wall 12 and the guide wall 114 as the former is moved. The telescoping connection 110 may further comprise a plurality of spring-loaded catches 124 which cooperate with an annular recess 124' to maintain the vertical position of the modular protective harbor wall 12 once raised. Upon release of the engaged spring-loaded catches 124, the modular protective harbor wall 12 may then be lowered. In an embodiment, the guide wall 114 and the modular protective harbor wall 12 may include rims 125 and 125', respectively, that mutually engaged upon the modular protective harbor wall 12 arriving at a desired vertical position relative to the guide wall 114 so as to serve as stops against further extension of the modular protective harbor wall 12.

In an embodiment, the modular protective harbor wall 12 may be provided flotation elements 20' for purposes of facilitating or effecting the raising and lowering of the modular protective harbor wall 12. The flotation elements 20' may comprise flotation tanks (caissons) operatively coupled to side portions of the modular protective harbor wall 12 which are sufficiently sized to raise and lower the modular protective harbor wall 12 upon the ballasting and deballasting of the flotation elements 20'. In an embodiment, the flotation elements 20' may be constructed similarly to those shown and described with regard to the modular flotation elements 20 of the modular flotation support 14 and may include an arrangement 26' for ballasting and deballasting the flotation element 20'. Alternatively or in addition, the flotation elements 20' may comprise inflatable bladders 21" that may be operatively coupled to the modular protective harbor wall 12 at convenient locations, such as the hooks 115, on a temporary basis or on a more permanent basis.

Referring now to FIG. 19, in an embodiment, the rack and pinion unit 112 may comprise a geared vertically oriented rack 130 disposed on the modular protective harbor wall 12 and a geared pinion wheel 132 operatively engaged with the rack 130. In the present embodiment, the rack 130 may attached to an exterior surface of the modular protective harbor wall 12 and the geared pinion wheel 132 rotatably supported at a location along an interior surface of the guide wall 114; however it is envisioned that they may be arranged the other way around with the rack 130 attached to an interior surface of the guide wall 114 and the geared pinion wheel 132 rotatably supported at a location along an exterior surface of the modular protective harbor wall 12. In an embodiment, several geared pinion wheels 132 may be vertically spaced from one another to operatively engage a common rack 130. In an embodiment, a motor 134 is operatively connected to the geared pinion wheel 132 so as to controllably drive the raising and lowering of the modular protective harbor wall 12. Although not depicted in FIG. 19, control of the motor 134 may be communicated from a controller through cables run to the surface or through a wireless connection or from a controller housed at a protected location in the protective harbor structure 10. Optionally, as depicted in FIG. 19, a releasable catch 136 may cooperate with the geared pinion wheel 132 to selectively maintain vertical positioning of the modular protective harbor wall 12.

Figure 22:
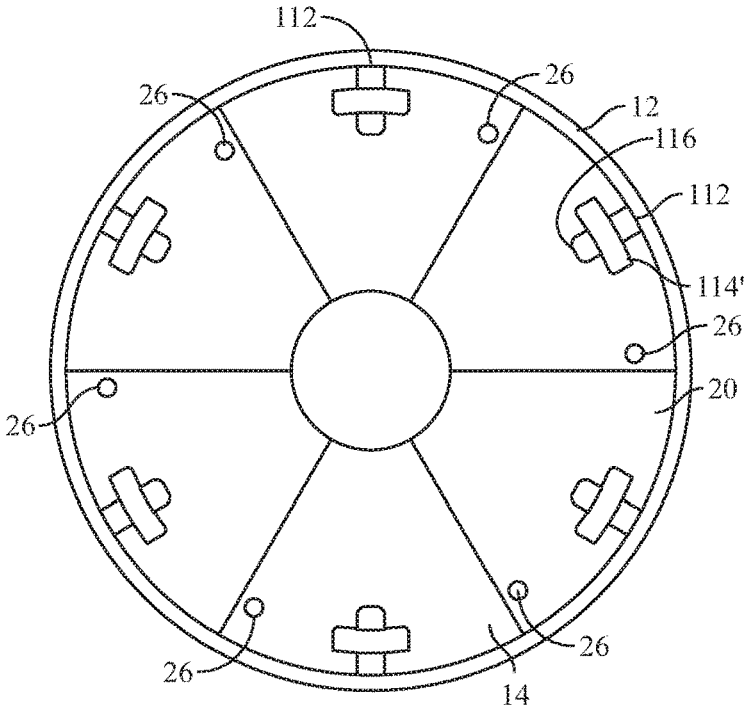
FIG. 22 is a top planar view of an embodiment wherein individual components of the telescoping connection are supported from a plurality of guideposts.
Figure 23:
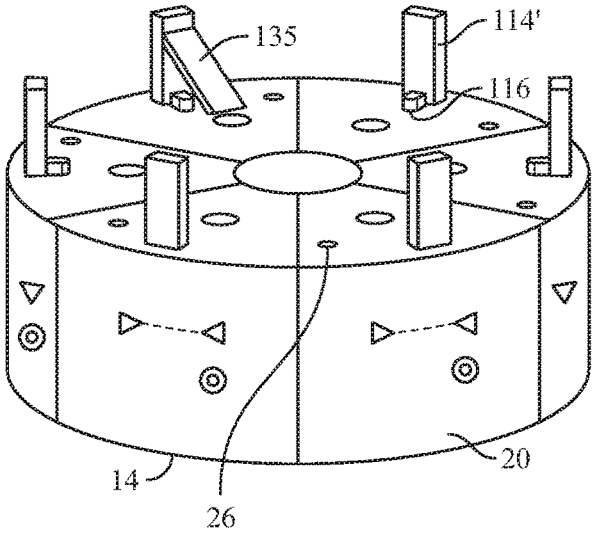
FIG. 23 is a perspective view of the guideposts shown in FIG. 22.

Referring now to FIGS. 22 and 23, in an embodiment, instead of the guide wall 114, the telescoping connection 110 may include a guide structure of guideposts 114', which may serve essentially all of the purposes of the guide wall 114, such as providing support for a plurality of rack and pinion units 112 and other components of the telescoping connection 110, but with a significant savings in weight. In an embodiment, the guide wall 114 and/or the guideposts 114' may be provided with a reinforcing brace or bracing framework 135 as shown in FIG. 23.

Referring back to FIG. 2, the modular protective harbor wall 12 may comprise a plurality of elongate, vertically oriented elements or panels 28 operatively coupled together in a side-by-side relation to form a hollow body 30 having open end portions 32 and 34. In the present embodiment, the hollow body 30 has a cylindrical form; however, the hollow body 30 of the protective harbor wall may be any suitable geometry, such as circular, elliptical, rectangular, square, or other polygons in transverse (radial) cross-sectional view. The form of the flotation support may have a similar geometry as the protective harbor wall or a different geometry as the protective harbor wall. In the present embodiment, each panel 28 may be cast from concrete and may include a vertically oriented, post tensioner 36 embedded therein. The post tensioner 36 may include a plurality of (embedded) anchors 36' and a tensioned tendon 36". In an embodiment, the panels 28 are operatively coupled together by a plurality of circumferentially directed post tensioners 38, each comprising opposing anchors 40, 42 which maintain steel tendons 44 in tension. The steel tendons 44 may extend completely around the circumference of the hollow body 30 or a portion thereof. In an embodiment, a series of post tensioners 38 may be disposed adjacent one another along the substantial longitudinal length of the modular protective harbor wall 12; however only a pair of circumferentially directed post tensioners 38 are shown in FIG. 2.

In an embodiment, the tensioners 36 of the panels 28 may be oriented other than vertical, and may include horizontal tensioners, and/or diagonal tensioners (tendons). It is also envisioned that the panels 28 may be constructed without prestressing or post tensioners and may be coupled to one another with pins, interlocking shear keys and other interlocking connections with or without prestressing or post tensioners.

Likewise, the post tensioners 38 disposed around the modular protective harbor wall 12 may be oriented other than what is specifically shown in the exemplary embodiment (FIG. 2). Alternatively to the assembly of panels 28, the protective harbor wall 12 may be cast as a single unit, such as a cast in place wall, with or without prestressing or post tensioners. It is understood that a cast unitary protective harbor wall may be used alternatively to the modular protective harbor wall 12 described herein to form the floatable modular protective structure 10.

Figure 9:
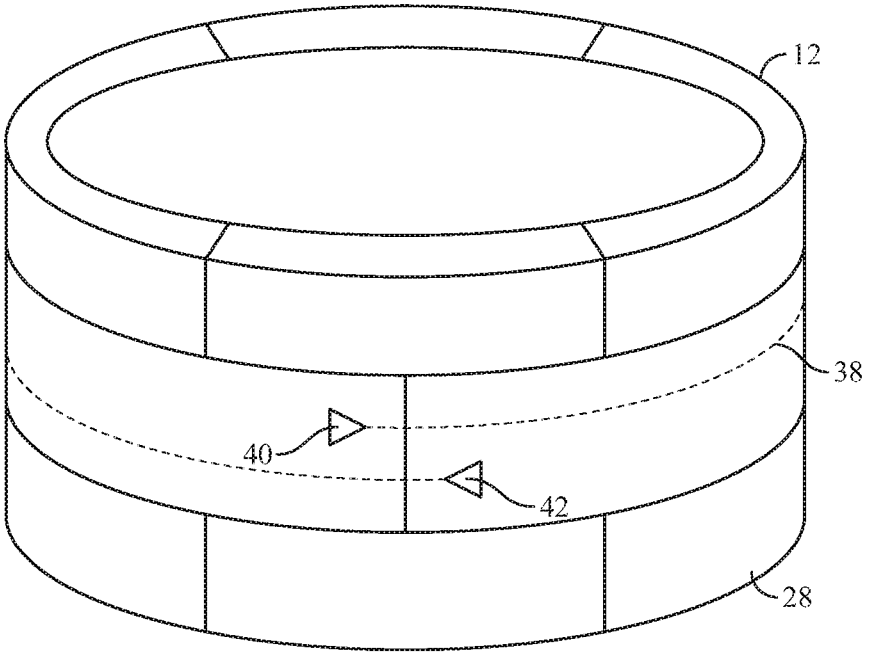
FIG. 9 is a perspective view of a modular protective harbor wall constructed in accordance with another embodiment of the present disclosure.

In yet another embodiment, the panels 28 may be arcuate and elongate in the circumferential direction, such as depicted in FIG. 9. Post tensioners 38 may be disposed circumferentially around the panels 28 to operatively couple the panels 28 together. The panels 28 may be prestressed horizontally, as shown in FIG. 9, and/or prestressed vertically. In some embodiments, the panels 28 may be constructed of metal alternatively or in addition to concrete.

The guide wall may be constructed using the same techniques and materials described herein for the construction of the protective harbor wall with adjustment for differences in size between the guide wall and the protective harbor wall.

Referring now to the embodiment of FIGS. 1, 2, and 3*a*, once constructed, the modular protective harbor wall 12 may be operatively coupled to modular flotation support 14 via the telescoping connection 110 in an axisymmetrical relation such that the modular protective harbor wall 12 is supported by the modular flotation support 14 at an upper, outer peripheral edge portion 55 of the modular flotation support 14. As described with reference to FIG. 21*a*, the guide wall 114 of the telescoping connection 110 may be secured to the modular flotation support 14 by connections 116 that may comprise a series of post-cast tensioners or other mechanical connectors, such as bolts, brackets, and other various forms of mechanical connections. Suitable connections may be adapted from those used in the construction of land based tank structures, such as those proposed in U.S. Pat. No. 4,069,642, which is incorporated herein by reference in its entirety.

Figure 4:
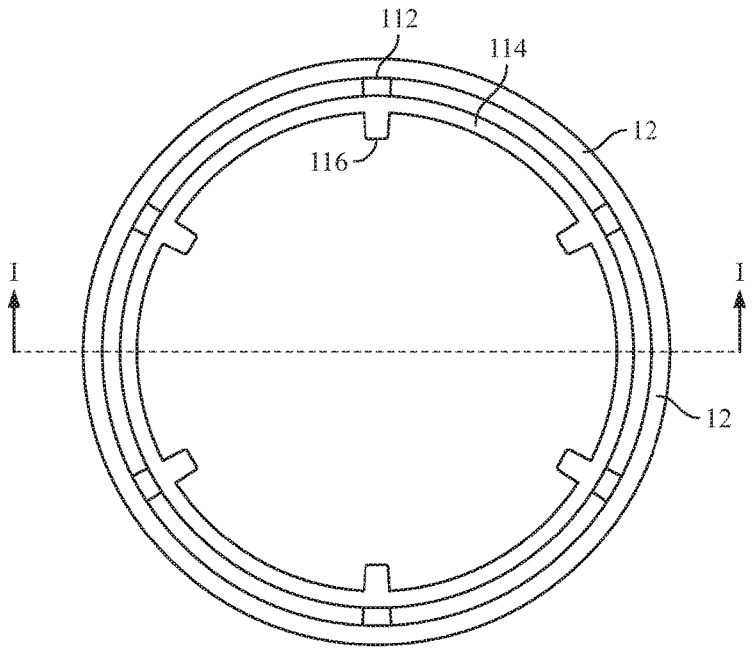
FIG. 4 is a top planar view of a modular protective harbor wall of the modular protective harbor structure of FIG. 1 including components of an exemplary telescoping connection.
Figure 5A:
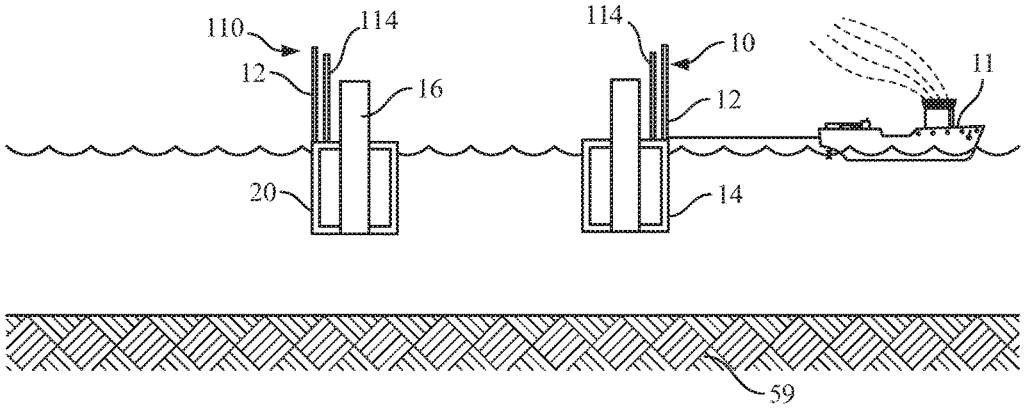
FIGS. 5*a-g* comprise a representation of an exemplary deployment sequence of the modular protective harbor structure of FIG. 1 and a jackup at an offshore site of operations in an ice-prone offshore environment with the modular protective harbor structure being shown in cross-section taken from the perspective of the double arrow I-I in FIGS. 3*a* and 4.
Figure 5B:
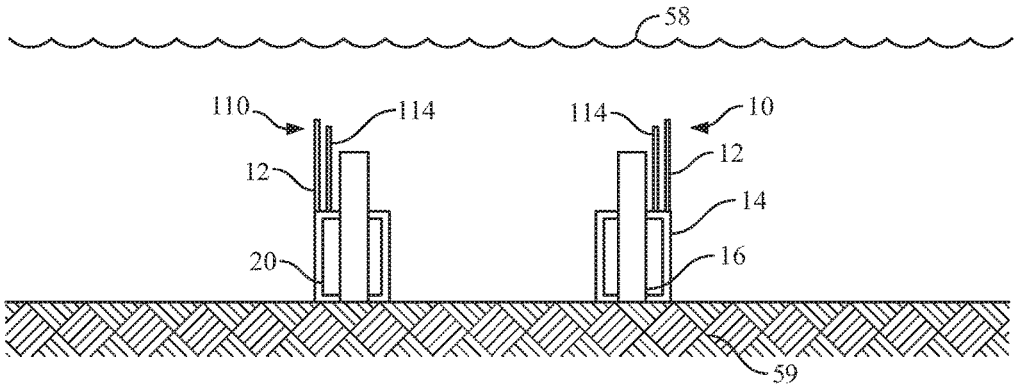
Figure 5C:
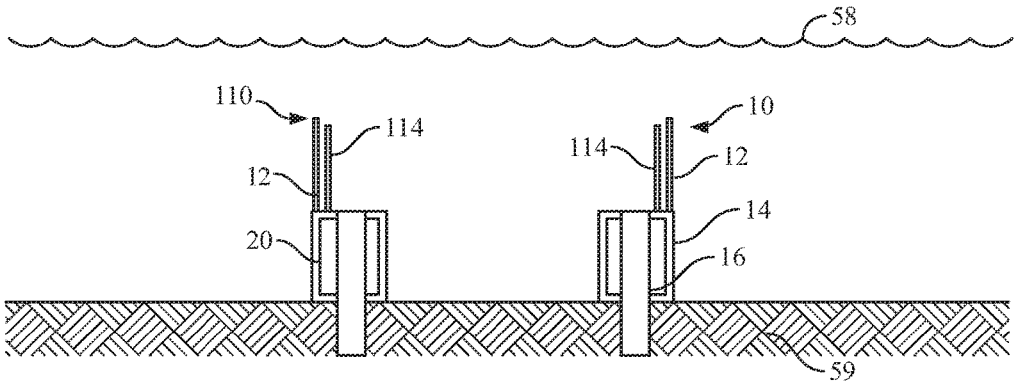
Figure 5D:
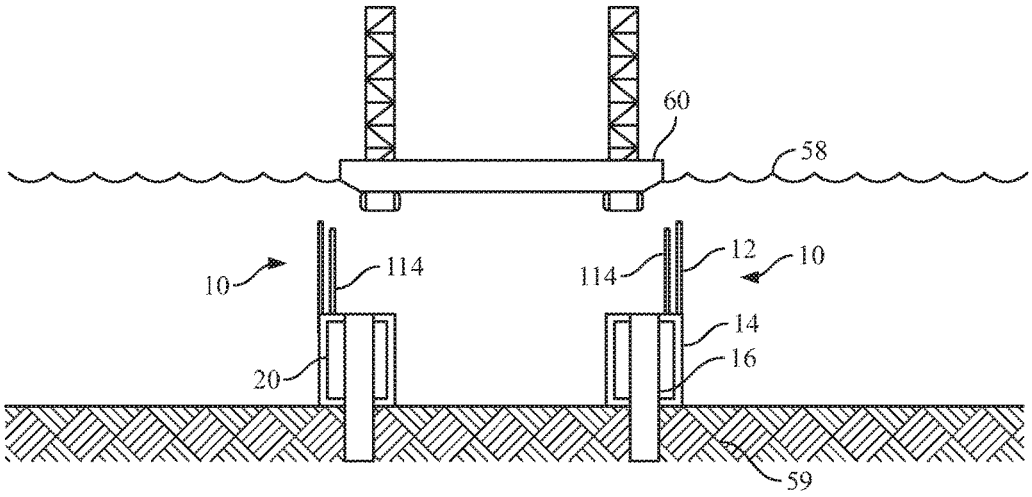
Figure 5E:
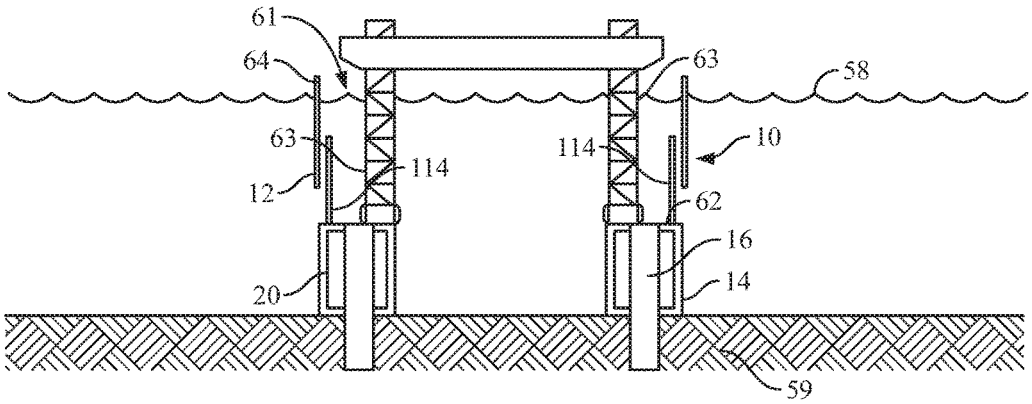

Referring now to FIGS. 5*a-g*, once constructed, the floatable modular protective harbor structure 10 may be towed by a vessel 11 or otherwise moved (floated) from the construction or assembly site to an offshore site of operations, which is depicted in FIG. 5*a*. The floatable modular protective harbor structure 10 of FIG. 1 is shown in cross-section taken along the double arrow I-I in FIGS. 3*a* and 4. Referring now to FIG. 5*b*, upon arrival at the offshore site of operations, the floatable modular protective harbor structure 10 is moved into a desired position at the site and submerged by ballasting at least some, if not all, of the modular flotation elements 20 of the modular flotation support 14 such that the modular protective harbor wall 12 is positioned upon the seabed 59 below the surface 58 at the offshore site. As shown in FIG. 5*d*, the depth may be sufficient to allow a floatable offshore vessel, such as a jackup 60, to move into position proximate the location of operations moving over the submerged modular protective harbor structure 10 with sufficient clearance with respect to the modular protective harbor wall 12. The anchorage system may be deployed by introducing a suction force or a driving force on the piles 16 to dispose a portion of the piles 16 into the seabed 59 to maintain the position and depth of the modular protective harbor structure 10, as shown in FIG. 5*c*.

The offshore vessel may be any suitable vessel used for offshore exploration, development or production activities, such as a drill ship, a MODU vessel, a floating production storage and offloading vessel, a floating liquefied natural gas vessel, a jackup, and/or any other floating service platforms. It is understood that any other support vessels, such as supply vessels, towing vessels, shipping vessels, and the like, may also be protected within the modular protective structure.

Referring now to FIG. 5*c*, once the protective harbor structure 10 has submerged and the modular flotation support 14 is positioned as desired on the seabed 59, the piles 16 are disposed into the seabed. The number of piles 16 deployed and their mutual spacing are selected so as to achieve a desired degree of stability and foundation capacity in the modular flotation support 14.

Referring now to FIGS. 5*d* and 5*e*, a jackup 60 is moved into position proximate the location of operations and within the harbor to be formed by the submerged protective harbor structure 10, whereupon jack stands 63 of the jackup 60 may be extended (lowered) until their lower ends come into contact with and find support from upper surface portions 62 of the modular flotation elements 20 at a location that is radially interior of the modular protective harbor wall 12. As depicted in FIG. 5*e*, the telescoping connection 110 is employed to raise the modular protective harbor wall 12 to a position where at least a portion 64 of the modular protective harbor wall 12 extends above the surface 58 at the offshore site such that the jack up 60 is enclosed within a harbor 61 established by the raised modular protective harbor wall 12. Once so positioned, the modular protective harbor wall 12 protects the jackup 60 from ice features in the body of water and other threats. Ice features may include icebergs, ice floes, pack ice, first-year ice, second-year ice or multi-year ice, and combinations thereof. It is to be understood that during such time, the guide wall 114, being operatively coupled (secured) to the submerged modular flotation support 14, remains beneath the surface 58.

When so arranged in ice-prone offshore environments, operations on the jackup 60 may initiate earlier (at or near the conclusion of an ice season) and continue longer into the beginning of the next ice season within the protection of the modular protective harbor wall 12. This arrangement is beneficial when the jackup 60 itself is not an ice capable vessel capable of withstanding forces from contact with ice. Accordingly, the arrangement provides significant potential for enhancing equipment utilization and for gaining significant additional operational time in ice-prone offshore environments annually.

Figure 5F:
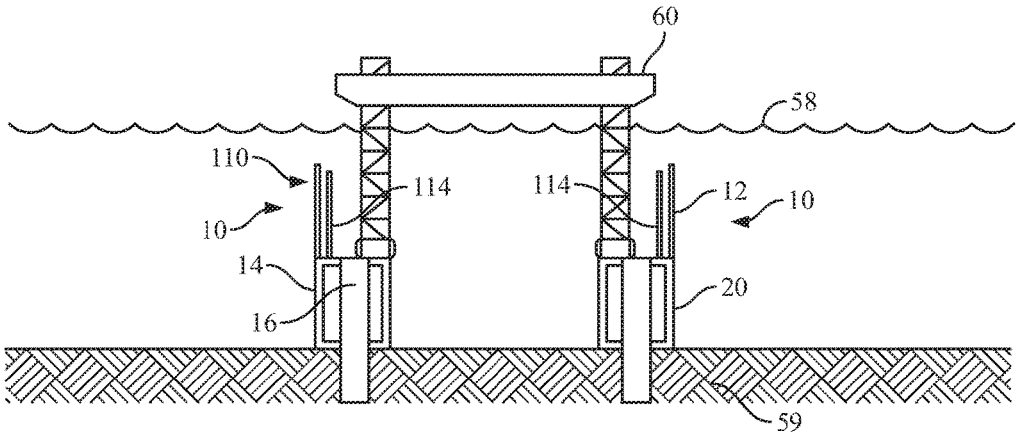
Figure 5G:
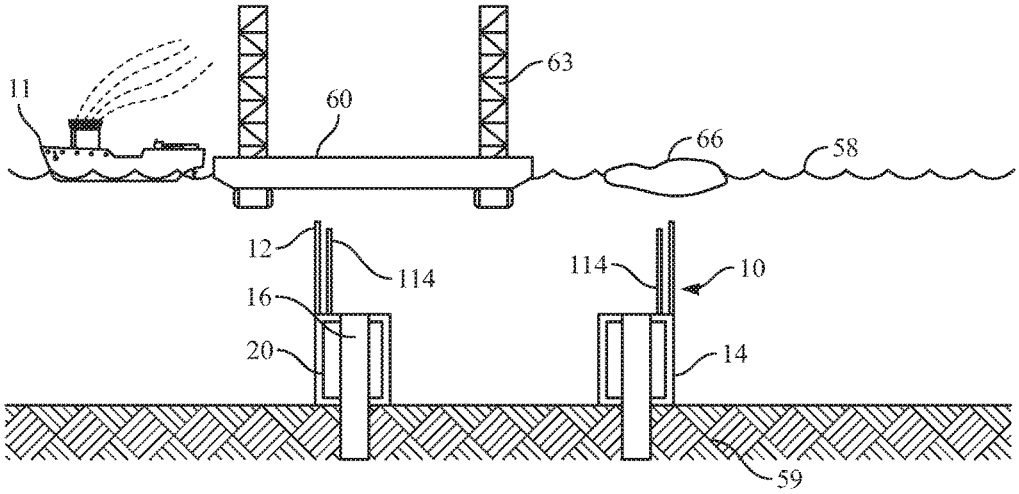

Referring now to FIGS. 5*f* and 5*g*, at the conclusion of operations, the telescoping connection 110 is employed to retract the modular protective harbor wall 12 to a depth sufficient for the jackup 60 to move from the site with clearance over the harbor wall 12. The move of the jackup 60 may be conducted with the assistance of an ice capable vessel 11. The protective harbor structure 10 may remain in the submerged position throughout the ice season of the ice-prone offshore environment at a depth sufficient to avoid impact damage from ice features 66 at the offshore site. Near conclusion of an ice season, the jack-up 60 may be returned (perhaps with the assistance of ice capable vessel 11) and the sequence of events as described above may be repeated. Alternatively, the modular protective harbor structure 10 may be raised by removing the piles 16 from the seabed 59 and deballasting (purging or removing) the modular flotation elements 20 at an appropriate time and moving the modular protective harbor structure 10 to another offshore site for reuse and to repeat the sequence of events as described above.

Although the above sequence of events are described with respect to a jackup 60, other offshore vessels described herein may be used. The offshore vessel may comprise any one or more of a variety of vessels, and in particular, any offshore vessels having utility in oil and/or gas exploration, in the development of oil and/or gas, and/or in the production of oil and/or gas (hydrocarbons).

Figure 6:
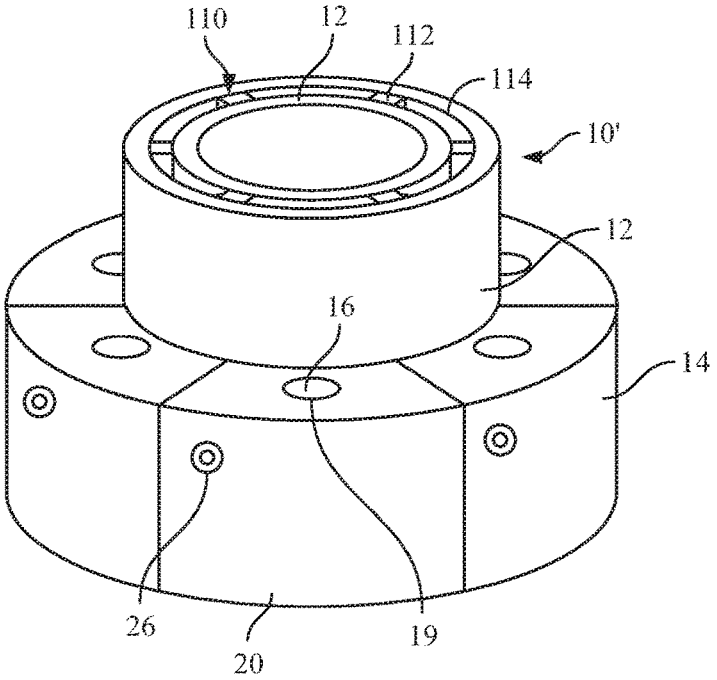
FIG. 6 is a perspective view of a modular protective harbor structure constructed in accordance with another embodiment of the present disclosure.
Figure 7:
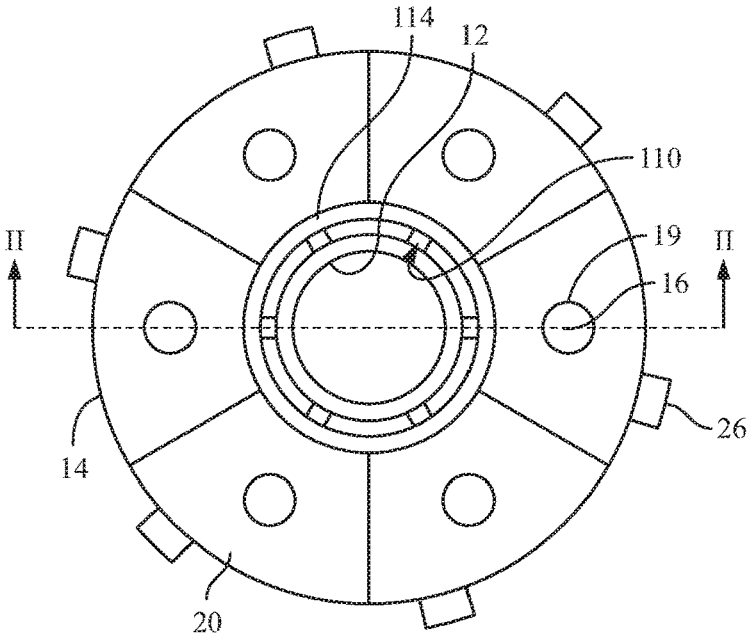
FIG. 7 is a top planar view of the modular protective harbor structure of FIG. 6.

Referring now to FIGS. 6 and 7, in another embodiment, the modular protective harbor structure 10' may comprise a modular protective harbor wall 12, a modular flotation support 14 and a telescoping connection 110 as described herein, but with the modular flotation elements 20 of the modular flotation support 14 being circumferentially disposed around an outer peripheral portion of modular protective harbor wall 12. By such arrangement the space (harbor) enclosed by the modular protective harbor wall 12 is free of a presence of the modular flotation support 14.

Figure 8A:
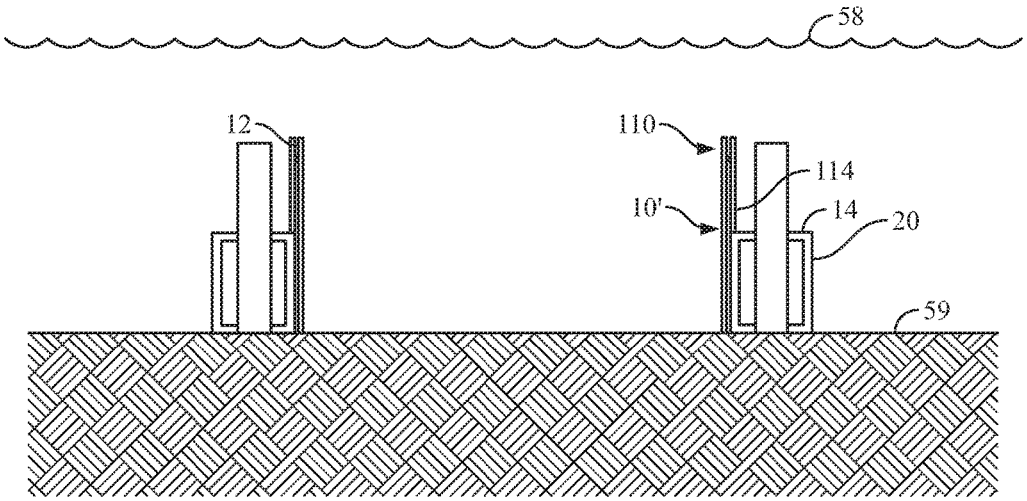
FIGS. 8*a-d* comprise a representation of an exemplary deployment sequence of the modular protective harbor structure of FIG. 7 and a MODU at an offshore site of operations in an ice-prone offshore environment with the modular protective harbor structure being shown in cross-section taken from the perspective of the double arrow II-II in FIG. 7.
Figure 8B:
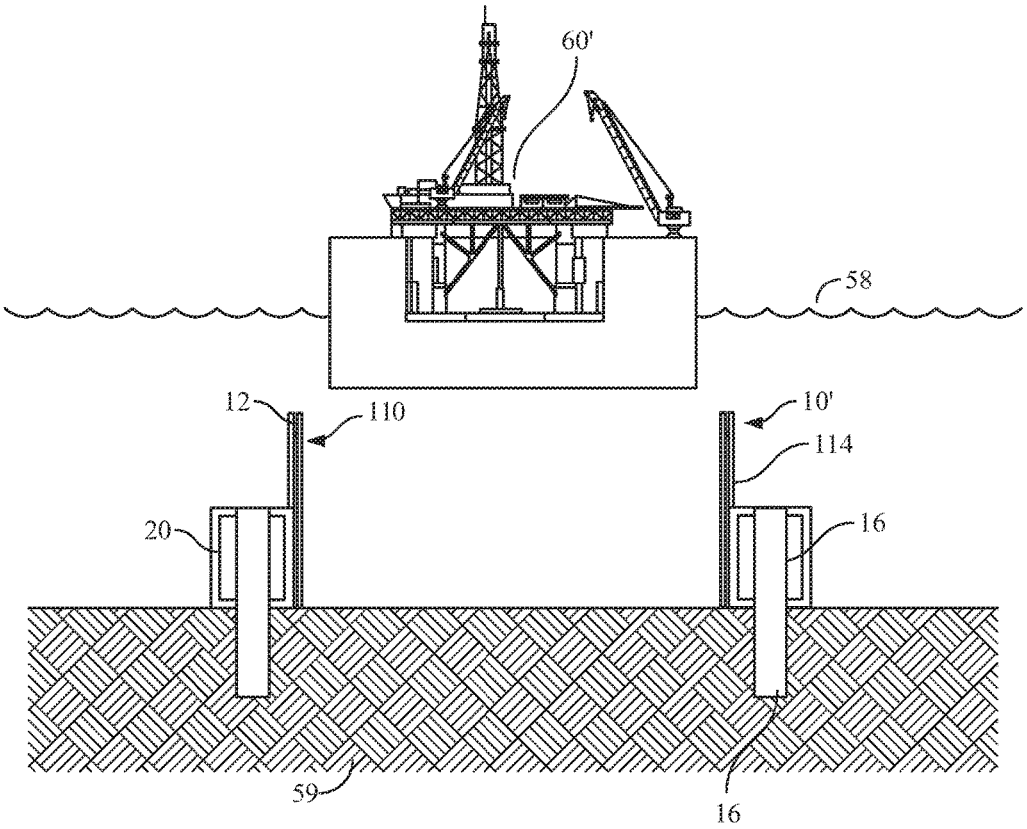
Figure 8C:
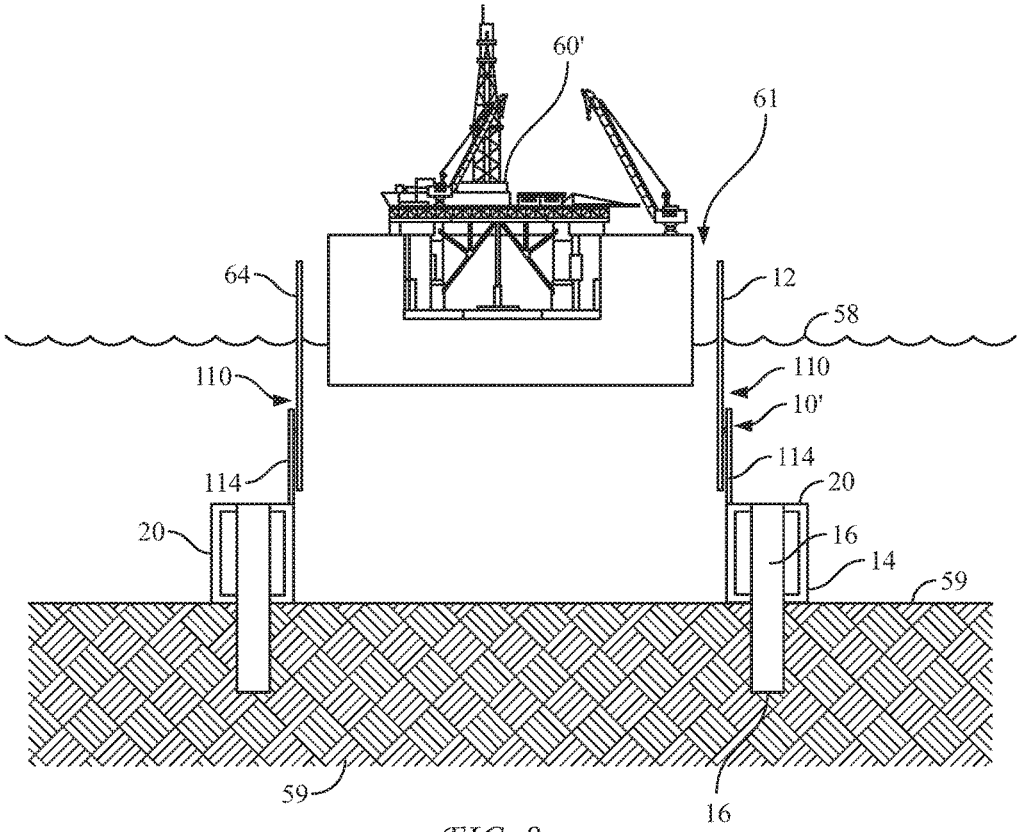

Referring now to FIGS. 8*a-d*, the modular protective harbor structure 10' of FIGS. 6 and 7 is moved into position at an offshore site of operations whereupon it is submerged as shown in FIGS. 8*a* and 8*b* such that modular flotation support 14 is positioned upon the seabed 59, whereupon the piles 16 are deployed and disposed within the seabed 59. The harbor structure 10' is at a depth sufficient for floating MODU vessel 60' to be moved into position proximate the location of operations and within the harbor to be formed by the submerged modular protective harbor structure 10'. As in the previously described sequence of events, the telescoping connection 110 is employed to raise the modular protective harbor wall 12 to a position where at least an upper portion 64 of the modular protective harbor wall 12 is disposed above the surface 58 so as to provide a protected harbor 61 for the MODU vessel 60' as shown in FIG. 8*c*. Although not shown, the MODU vessel 60' may be moored either to the modular protective harbor structure 10' or alternatively or in addition directly to the seabed 59.

Figure 8D:
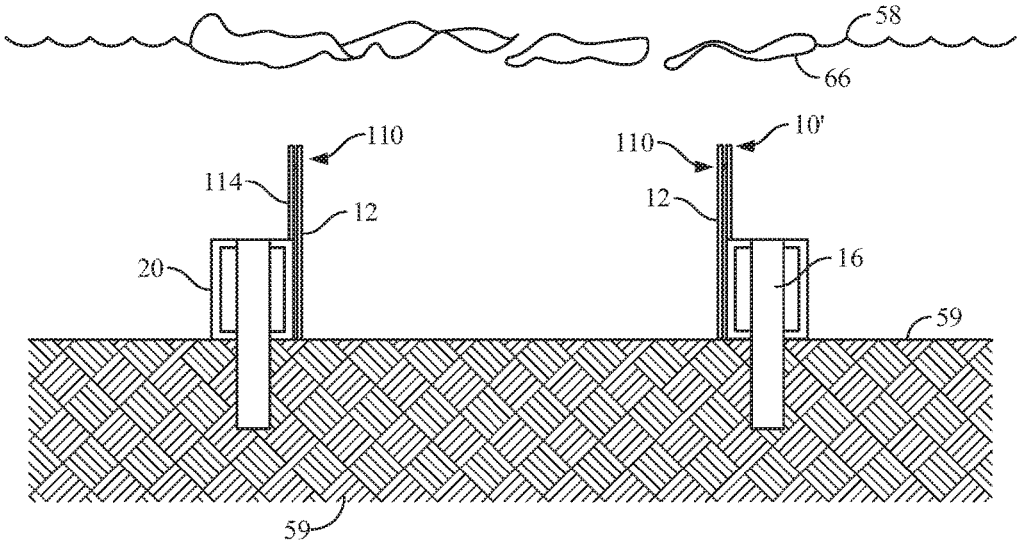

At conclusion of operations, the telescoping connection 110 is employed to return the modular protective harbor wall 12 to its retracted position at a depth sufficient for the MODU vessel 60' to move from the offshore site with clearance over the modular protective harbor wall 12, which move may be undertaken with the assistance of an ice capable vessel. As shown in FIG. 8*d*, the modular protective harbor structure 10' may remain submerged throughout the ice season of the ice-prone offshore environment at a depth sufficient to avoid impact damage from ice features 66 at the site. During such time, the piles 16 may remain deployed to maintain the modular protective harbor structure 10' at the desired depth and location. Near the conclusion of an ice season, the MODU vessel 60' may be returned (perhaps with the assistance of ice capable vessel) and the sequence of events as described above may be repeated.

Alternatively, the modular protective harbor structure 10' may be raised by removing the piles 16 from the seabed 59 and deballasting (purging or removing) the modular flotation elements 20 at an appropriate time and moved to another offshore site for reuse and to repeat the sequence of events as described above.

Figure 10A:
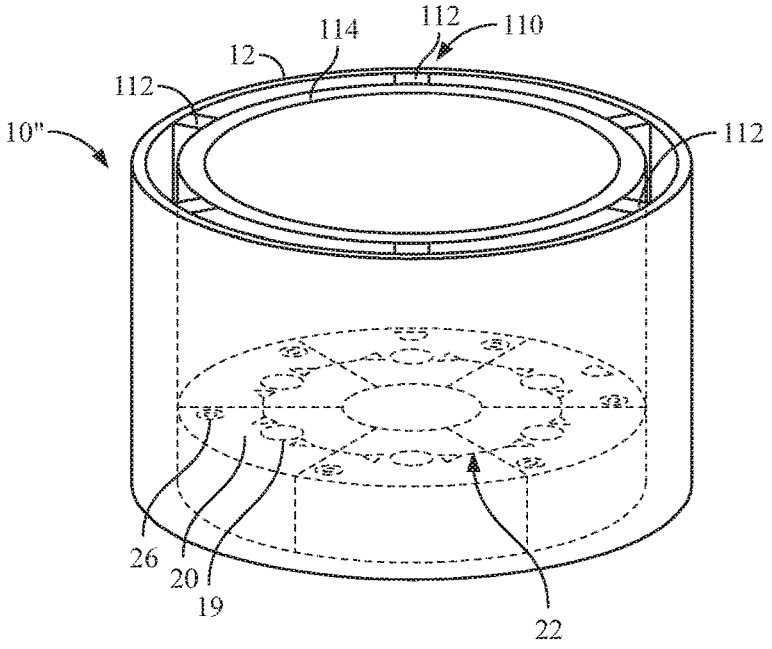
FIG. 10*a* and FIG. 10*b* is a perspective view and a top view, respectively, of a modular protective harbor structure constructed in accordance with another embodiment of the present disclosure.
Figure 10B:
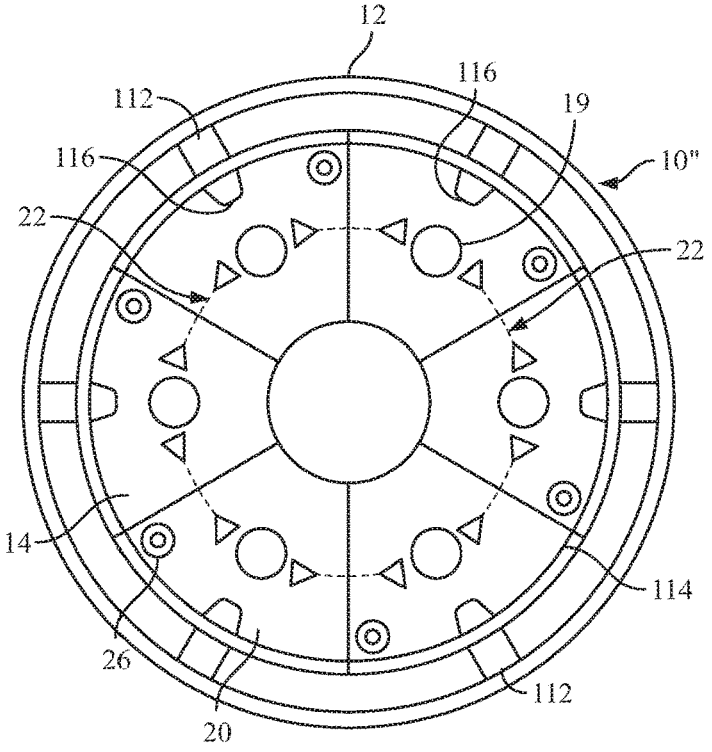

Referring now to FIGS. 10*a* and 10*b*, in yet another embodiment, the protective harbor structure 10" may comprise a modular protective harbor wall 12, a modular flotation support 14 and a telescoping connection 110 as described herein, but with the modular flotation elements 20 of the modular flotation support 14 being disposed within an interior of guide wall 114 and operatively coupled thereto. By such arrangement the space (harbor) enclosed by the modular protective harbor wall 12 is provided with a shelf by the presence of the modular flotation elements 20 for supporting jack stands or the like. In the arrangement, the guide wall 114 may enclose and protect the modular flotation elements 20, and the disposition of the annulus 23 of the modular flotation elements 20 may serve to reinforce (brace) the guide wall 114. The embodiment of FIGS. 10*a* and 10*b* may be deployed in accordance with a sequence of events, such as described with reference to FIGS. 5*a-g* and/or FIGS. 8*a-d*.

Figure 11A:
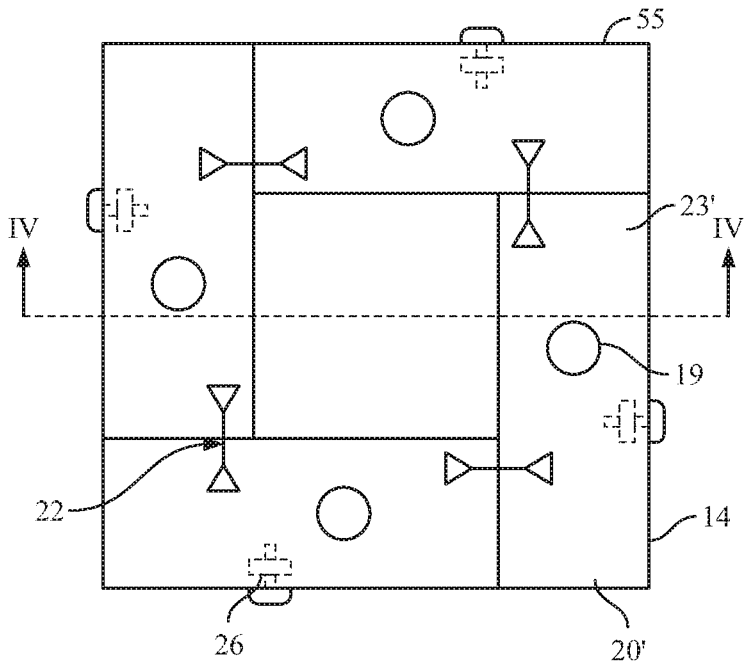
FIG. 11*a* and FIG. 11*b* are top planar views of a modular flotation support and a modular protective harbor wall, respectively, of a modular protective harbor structure in accordance with a rectangular embodiment of the present disclosure.
Figure 11B:
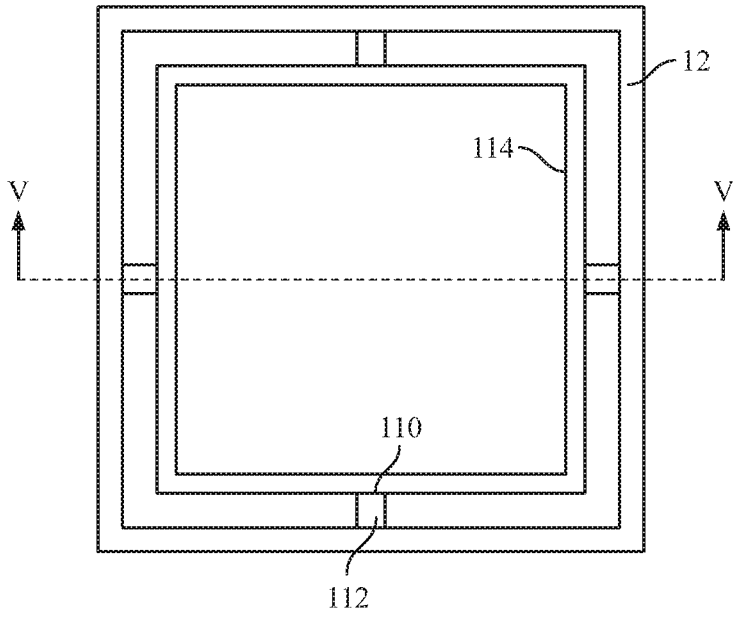
Figure 12:
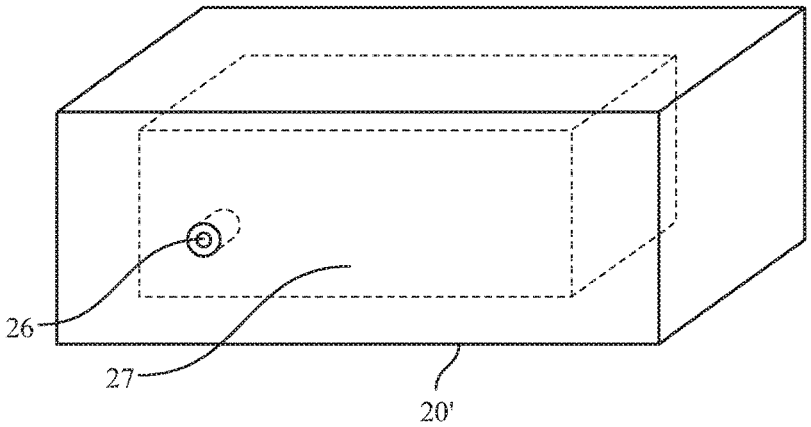
FIG. 12 is a perspective view of a discrete flotation element of the modular flotation support shown in FIG. 11*a*.

Referring now to FIGS. 11*a* and 11*b* in yet another embodiment, the modular protective harbor structure may comprise a rectangular modular protective harbor wall 12, a rectangular modular flotation support 14 and a telescoping connection 110 as described herein, but with modular flotation elements of the modular flotation support 14 each being in the form of a discrete, modular rectanguloid flotation block 20', such as shown in FIGS. 11*a* and 12. In the present embodiment, the modular rectanguloid flotation blocks 20' are operatively coupled together in an exemplary end to side relation and secured by connectors 22 to form a rectangular annulus 23'. As in the embodiment described with respect to FIGS. 1 and 3*b*, each modular rectanguloid flotation block 20' includes an inner chamber 27 and an arrangement 26 including a ballast pump, valve, and conduit (not shown) operative to ballast and deballast (purge or remove ballast fluid from) the inner chamber 27. The exemplary rectangular annulus 23' of FIG. 11*a* comprises four modular rectanguloid flotation blocks 20'; however, a greater number of modular rectanguloid flotation blocks 20' may be employed to construct a different form of a rectangular annulus 23' (such as a more elongate or deeper one) or other form of shaped body for the modular flotation support 14.

Figure 13:
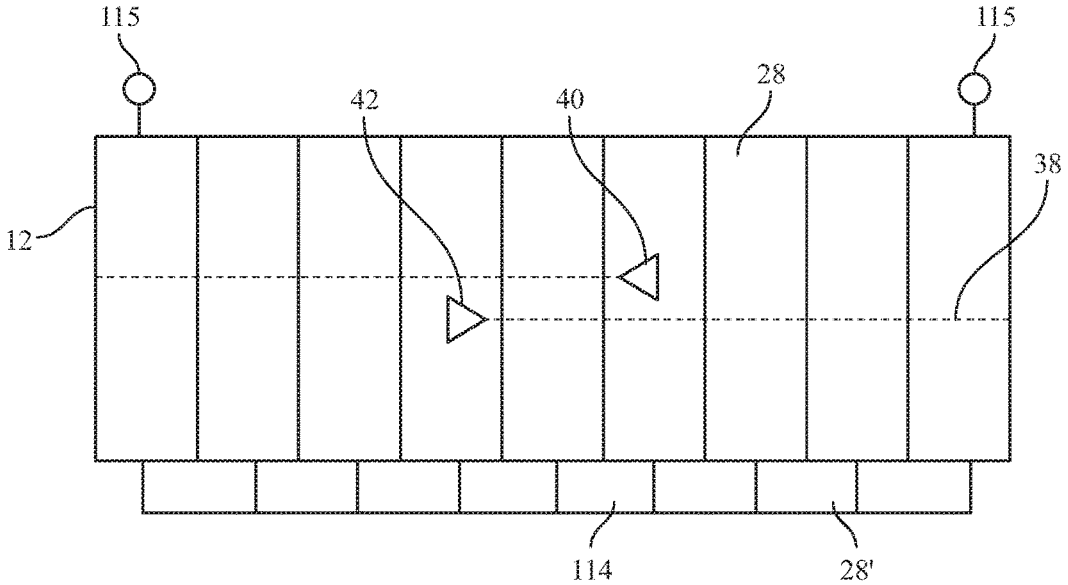
FIG. 13 is a planar side view of the modular protective harbor wall shown in FIG. 11*b*.

Referring now to FIGS. 11*b* and 13, the rectangular modular protective wall 12 of the present embodiment is constructed of vertically oriented panels 28 and a post-cast tensioner 38 as described with regard to the embodiment in reference to FIG. 2. Alternatively, the plurality of vertically oriented panels 28 may be operatively coupled with a circumferential wire wrapping thereabout with a protective layer applied thereto. Alternatively, panels 28 may instead be oriented horizontally, as shown in FIG. 9. The guide wall 114 may be constructed using the same techniques used in the construction of the modular protective harbor wall 12. As illustrated in FIG. 13, the rectangular modular guide wall 114 may be constructed of vertically oriented panels 28' and a post-cast tensioner (not shown). Once constructed, the rectangular modular guide wall 114 may be attached to the rectangular modular flotation support 14 such that protective wall 12 is situated at the outer perimeter 55 (FIG. 11*a*) of the rectangular modular flotation support 14.

The embodiment of FIGS. 11*a* and 11*b* is suited for deployment in ice-prone environments, such as being deployed in accordance with a sequence of events, such as described with reference to FIGS. 5*a-g*, wherein the rectangular modular flotation support 14 may be represented from the perspective of the double arrow IV-IV in FIG. 11*a* and the rectangular modular protective harbor wall 12 and the telescoping connection 110 may be represented from the perspective of the double arrow V-V in FIG. 11*b*.

Figure 14A:
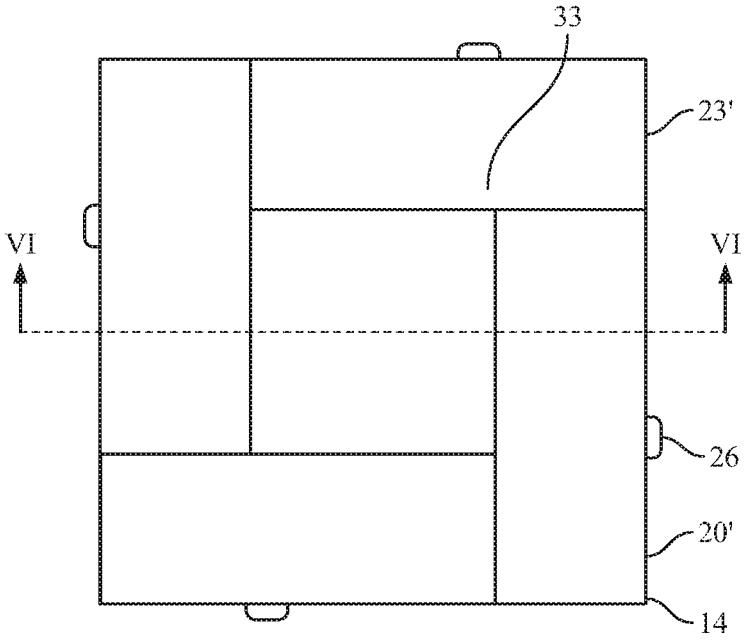
FIG. 14*a* and FIG. 14*b* are top planar views of a modular flotation support and a modular protective harbor wall, respectively, of a modular protective harbor structure in accordance with another rectangular embodiment of the present disclosure.
Figure 14B:
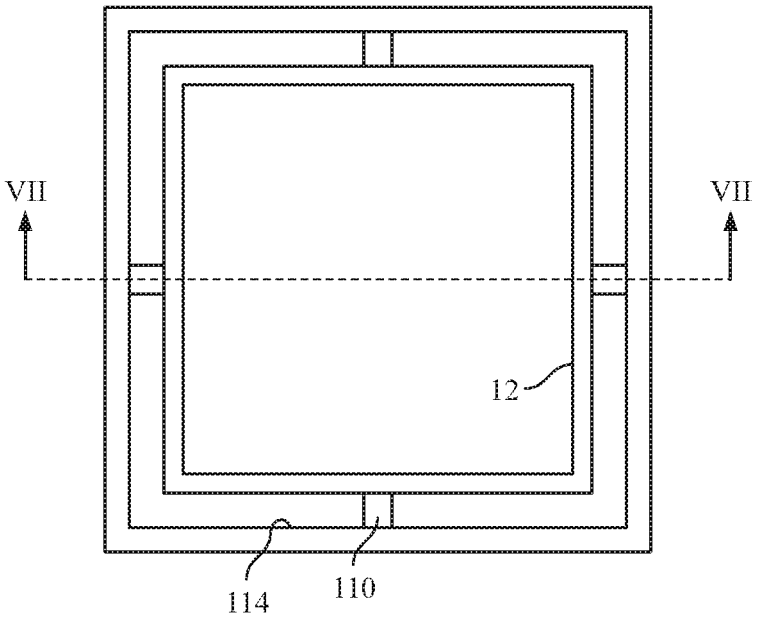

Referring now to FIGS. 14*a* and 14*b*, in still another embodiment, the modular protective harbor structure may comprise a rectangular modular protective harbor wall 12, a rectangular modular flotation support 14 and a telescoping connection 110 as described with reference to FIGS. 11*a* and 11*b*, but wherein the relative size and/or dispositions of the rectangular modular protective harbor wall 12, the rectangular modular guide wall 114 and the rectangular modular flotation support 14 are such that the rectangular modular guide wall 114 is situated atop an inner periphery 33 of the rectangular annulus 23' of the modular flotation support 14 and the rectangular modular protective harbor wall 12 is disposed radially interior of the rectangular modular guide wall 114. Alternatively, the protective harbor wall 12 and the guide wall 114 may both be situated to extend at least partially through the opening defined by the rectangular annulus 23'. In the latter case, the guide wall 114 would be disposed outside of the modular protective harbor wall 12 and operatively coupled to the rectangular modular flotation support 14. Otherwise the construction and features of the embodiment shown in FIGS. 14*a* and 14*b* is similar to those of FIGS. 11*a* and 11*b* and is particularly suited for deployment in ice-prone environments, such as being deployed in accordance with a sequence of events as described with reference to FIG. 8*a-d*, wherein the rectangular modular flotation support 14 of FIG. 14*a* may be represented from the perspective of the double arrow VI-VI in FIG. 14*a* and the rectangular modular protective harbor wall 12 and the telescoping connection 110 of FIG. 14*b* may be represented from the perspective of the double arrow VII-VII in FIG. 14*b*.

Figure 15:
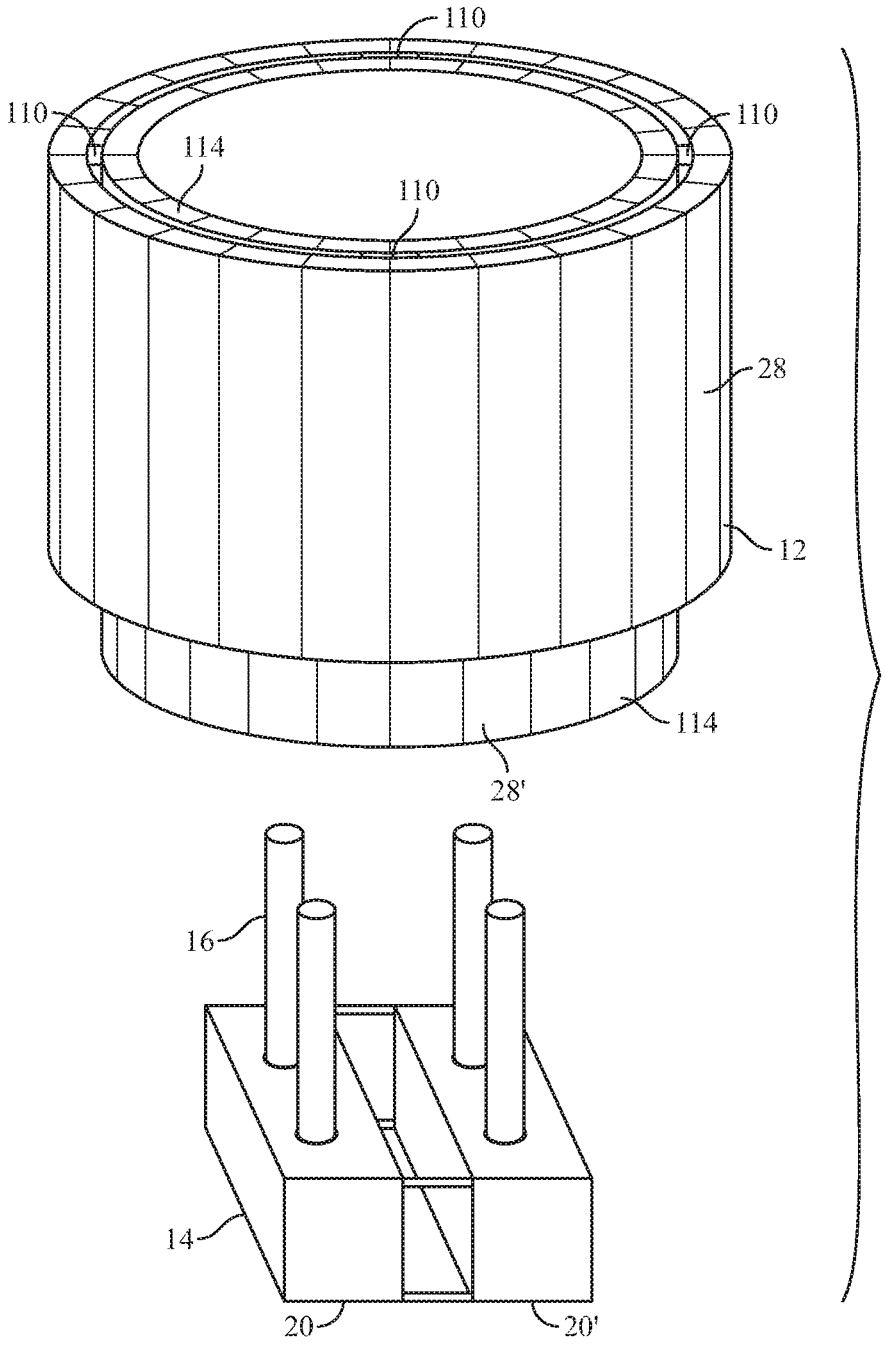
FIG. 15 is an exploded perspective view of a modular protective harbor structure in accordance with another embodiment of the present disclosure.

Referring now to FIG. 15 it is contemplated that a cylindrical modular protective harbor wall 12 and a cylindrical modular guide wall 114 of the embodiments described herein may be combined with the rectangular modular flotation support 14 of another embodiment and although not shown a rectangular protective harbor wall 12 and rectangular guide wall 114 may be combined with a circular flotation support 14. In the embodiment shown in FIG. 15, a first and second modular flotation caisson 20 and 20' are mutually configured as pontoons.

Figure 16A:
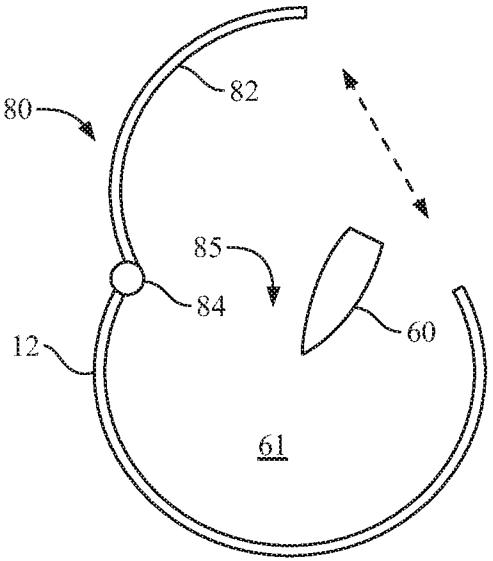
FIGS. 16*a-c* are top planar representations of protective harbor walls which include features of a gate suitable for application in the various embodiments of modular protective harbor structures disclosed herein.
Figure 16B:
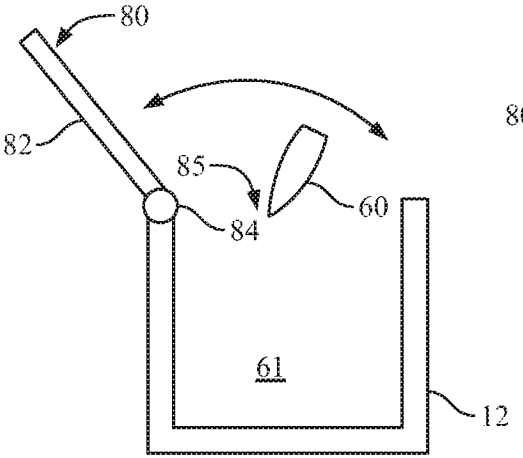

The embodiments described herein may be provided with enhanced harbor operation and access by provision of a gate 80, which in the case of the embodiments shown in FIGS. 16*a* and 16*b*, may comprise a pivotable floating gate 82 that may pivot about a hinge 84 to an open position where offshore vessels 60 may enter or leave the harbor 61 defined by the modular protective harbor wall 12 through the opening 85, and a closed position where vessel 60 may be moored and protected within the harbor 61 enclosed by the modular protective harbor wall 12 and the closed gate 80.

Figure 16C:
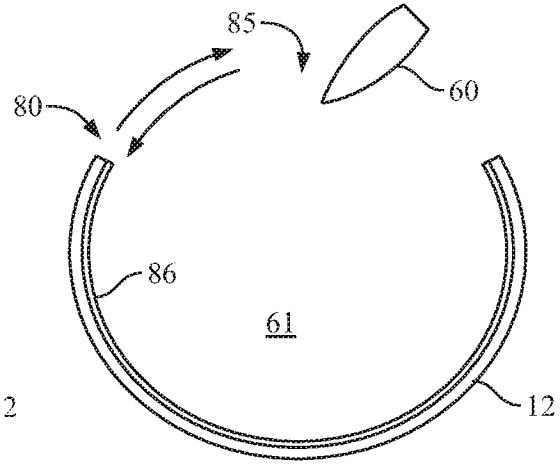

In the embodiment of FIG. 16*c* the gate 80 comprises a sliding partition 86 that is disposed concentrically with respect to the modular protective harbor wall 12. In an embodiment, the sliding partition 86 is a floating partition. The partition 86 is particularly suited to embodiments herein whose modular protective harbor wall 12 is cylindrical. As shown FIG. 16*c*, the partition 86 is movable from an open position where offshore vessels 60 may enter or leave the harbor 61 defined by the modular protective harbor wall 12 through the opening 85 and a closed position where vessel 60 may be moored and protected within the harbor 61 enclosed by the modular protective harbor wall 12 and the closed gate 80.

With embodiments that include a gate 80, such as any of those described with reference to FIGS. 16*a-c*, the modular protective harbor structure may be transported to the offshore site and raised in the absence of the offshore vessel 60, which may thereafter be moved into the protective harbor 61 upon opening the gate 80. The offshore vessel 60 need not be pre-positioned proximate the location of operations within the harbor formed by modular protective harbor wall 12 before the protective harbor wall is raised to the raised position. Likewise, at the conclusion of operations, the offshore vessel 60 may be moved from the harbor by opening the gate 80. The gate 80 may be opened and closed to accommodate the ingress or egress of the offshore vessels 60 into and out of the harbor 61 created by the modular protective harbor structure without retracting (submerging) the modular protective harbor wall 12, which facilitates operations.

Figure 17A:
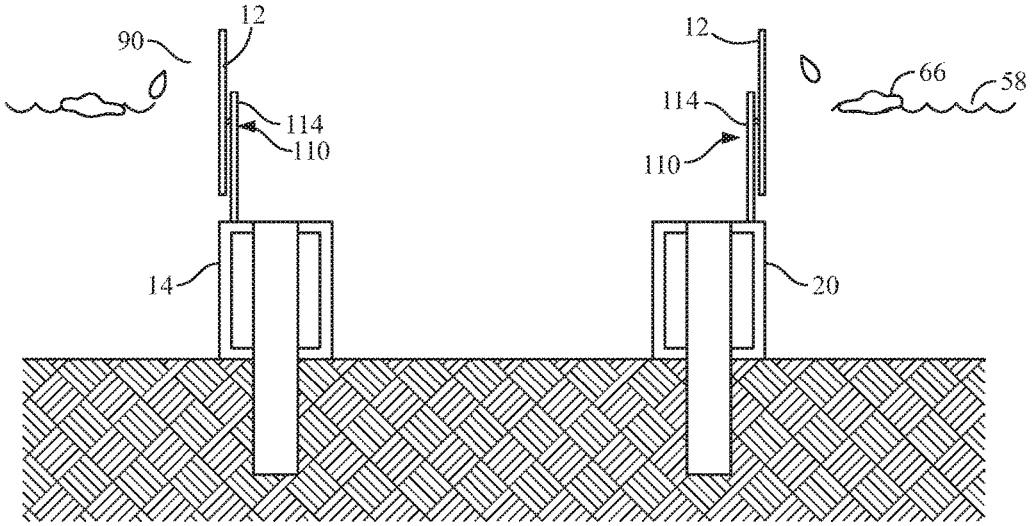
FIGS. 17*a* and 17*b* are cross-sectional representations of the modular protective structures of the various embodiments with arrangements to deflect ice features.
Figure 17B:
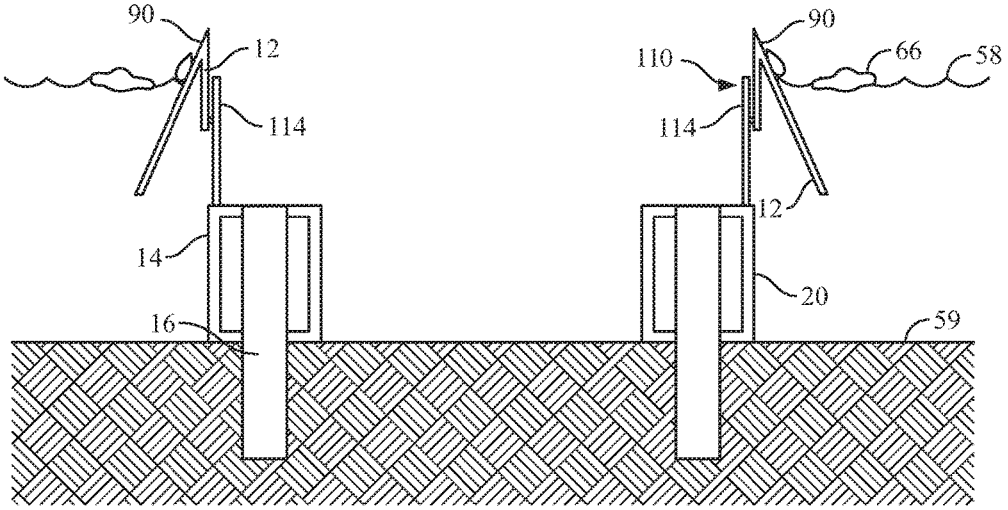

Referring now to FIGS. 17*a* and 17*b*, the protective harbor wall 12 of the embodiments described herein may be provided enhanced resistance to ice features in the body of water by provision of deflectors 90 around the exterior of the protective harbor wall 12 at or about the waterline (or surface 58), such that an ice feature 66 in the body of water is directed (deflected) upwardly and breaks in flexure. With the upward deflection of the ice features 66, a downward reactive force against the deflector 90 of the protective harbor wall 12 helps maintain the modular protective harbor structure 10 in its bottom-founded anchored position.

The modular protective structure and protective harbor wall may be constructed and arranged to have a strength sufficient to withstand at least first-year ice conditions. First-year ice conditions include ice thicknesses up to 2 meters (m) which may also include first-year ice ridges. The modular protective structure and protective harbor wall may be constructed and arranged to have a strength sufficient to withstand second-year ice conditions or other multi-year ice conditions. Such second-year ice conditions or other multi-year ice conditions may be of varying strengths and thicknesses typically associated with such ice. Being able to withstand second-year ice conditions or other multi-year ice conditions can provide a year round capacity to protect the non-ice capable offshore vessel within the harbor.

In the embodiment shown in FIG. 17*b*, the deflector 90 is an inclination of the substantial length of the protective harbor wall 12 such that moving ice features 66 contacting the protective harbor wall 12 are directed upwardly. Alternatively, only a portion of the length of the protective harbor wall 12 at or about the waterline (or surface 58) is inclined such that moving ice features 66 contacting such inclined portion of the protective harbor wall 12 are directed upwardly.

Referring now to FIGS. 18*a-d*, in an embodiment, there is provided a method of constructing a modular protective harbor structure 10 by an assembly sequence of its modular components.

Figure 18A:
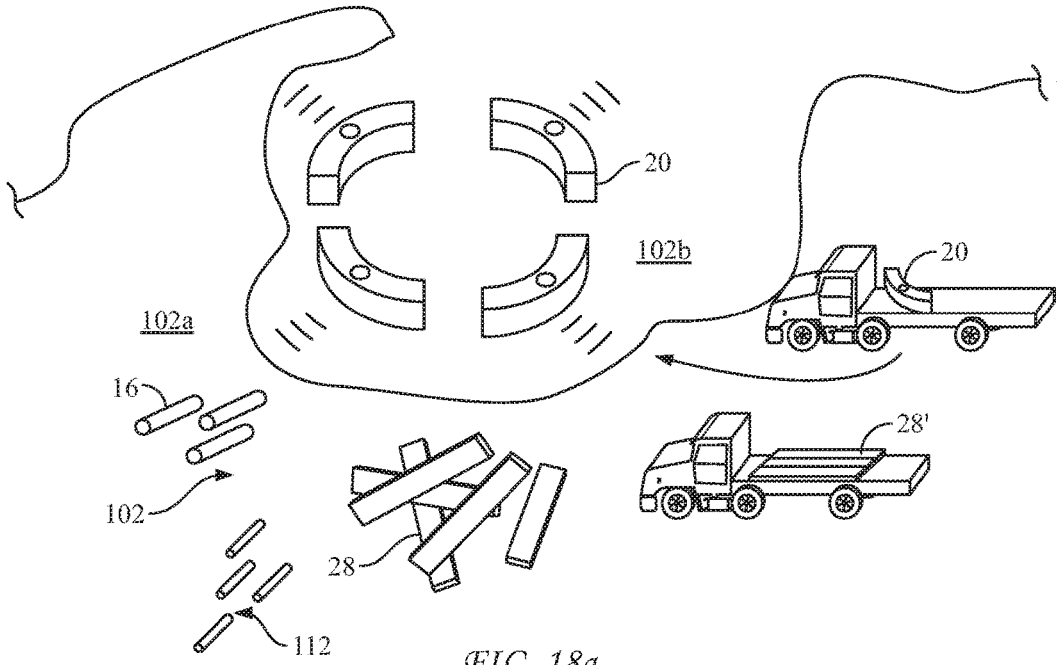
FIGS. 18*a-d* comprise a representation of an exemplary construction sequence of a floatable modular protective harbor structure in accordance with an embodiment of the present disclosure.

Referring now to FIG. 18*a*, at assembly site 102, modular panels 28 for the modular protective harbor wall 12 and modular panels 28' for the guide wall 114 are transported to the assembly site 102, or alternatively, the modular panels 28, 28' are themselves constructed at the assembly site 102. The assembly site 102 may include a land-based portion 102*a* and a water-based portion 102*b*. A supply of piles 16 and components of the telescoping scoping connection 110 (such as the rack and pinion units 112) are established at the assembly site 102.

Figure 18B:
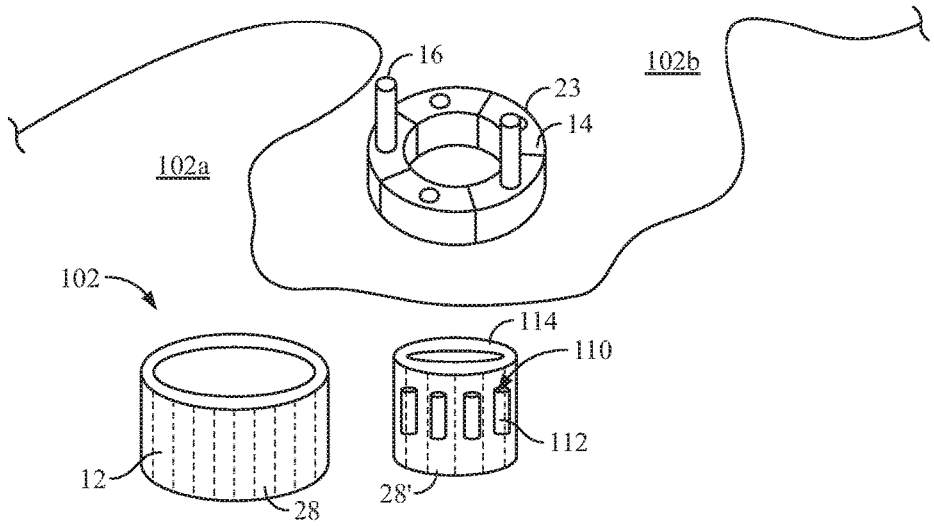

The modular flotation elements 20 of modular flotation support 14 are either transported to the assembly site 102 or alternatively, constructed at the assembly site 102 with materials, such as concrete and/or steel, that are available at the assembly site 102 or transported to the assembly site 102. Referring now also to FIG. 18*b*, in an embodiment, each of the modular flotation elements 20 are then launched individually into a body of water 102*b* and brought together and operatively coupled in the form of the annulus 23 of the modular flotation support 14 while floating. In the alternative, some or all of the modular flotation elements 20 may be operatively coupled together on land 102*a* and then launched into a body of water 102*b*. The assembly of the modular protective harbor wall 12 and the modular guide wall 114 may proceed on land 102*a* at the assembly site 102; however, in other embodiments, the modular protective harbor wall 12 and the modular guide wall 114 may be constructed in whole or in part directly upon the operatively coupled modular flotation elements 20 instead of being constructed separately from the modular flotation support 14. The piles 16 may be placed within the modular flotation support 14 while the modular flotation support 14 is afloat at the assembly site 102 before transporting to the site of operations or at the site of operations.

Figure 18C:
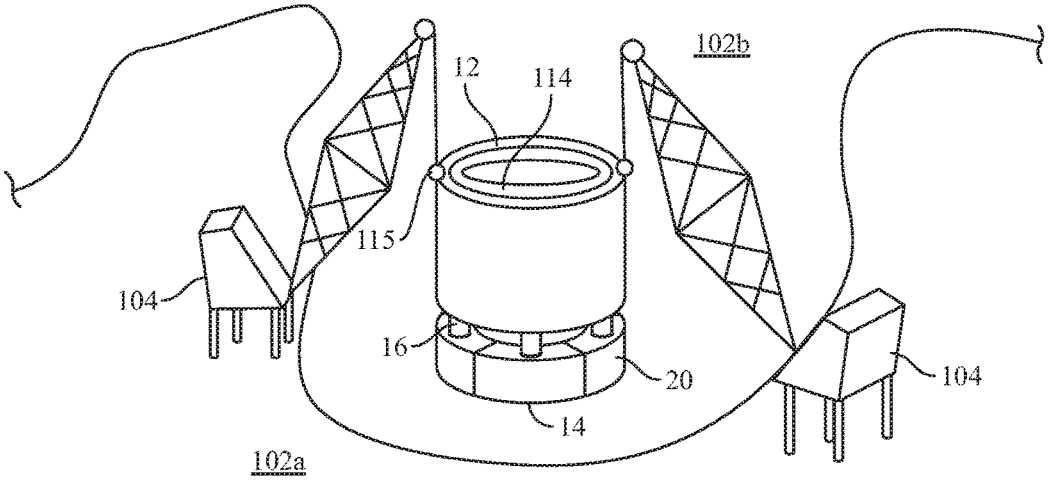
Figure 18D:
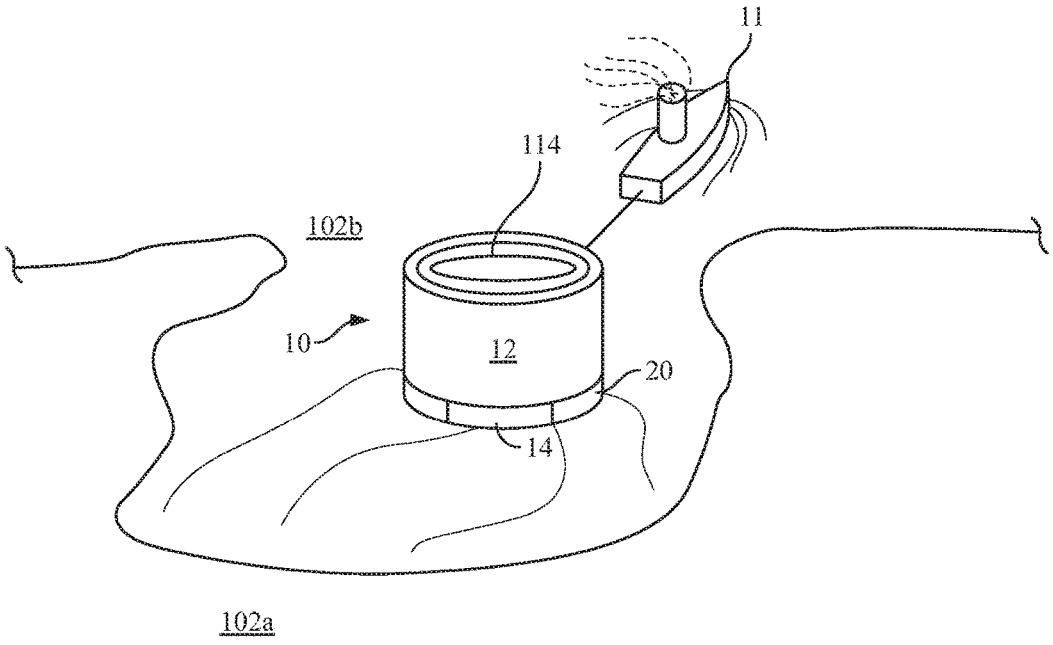

Referring now to FIG. 18*c*, in an embodiment, upon completion of the assembly of the modular protective harbor wall 12 and the modular guide wall 114, they are combined together with the telescoping connection 110 and positioned upon the annulus 23 of the modular flotation support 14. Such positioning may utilize water-based or land-based, heavy lift equipment 104. Once positioned, the guide wall 114 is operatively coupled (secured) to the annulus 23 of the modular flotation support 14. The resultant protective harbor structure 10 is then readied to be moved (towed) with vessel 11 from the assembly site 102 to the offshore site of operations, as shown in FIG. 18*d*.

The above described method of assembly is advantageous in facilitating construction of a large seaworthy structure, such as the modular protective harbor structure 10 in regions of the world, such as ice-prone offshore environments, where large-scale dry docks and other resources may not be available or at best limited in size and/or capability.

The above teachings also permit the use a non-ice capable vessel in combination with an ice-protective modular harbor structure which avoids a need for vessel strengthening associated with ice capable vessels and also accommodates use of any widely available non-ice capable vessels by separating the ice-resistance function from the exploration, development, and/or production activities of the vessel. The "harbor" also makes it possible to extend the service time of such vessels in ice-prone offshore environments, such as Arctic or sub-Arctic offshore environments, which enhances utilization of such vessels and provides opportunity for increasing operating income from an extension of service time. The stowing of the modular protective harbor structure during times of heavier ice conditions simplifies operations. It is also possible to provide the protective harbor wall with sufficient strength through bracing, advanced design, selection of materials and other resources to achieve enhanced capability to resist ice features and provide a "harbor" having an extended operating capability, such as near year-round or year-round operating capability, in ice-prone offshore environments.

INDUSTRIAL APPLICABILITY

The structures and methods disclosed herein are applicable to the oil and gas industry.

Illustrative, non-exclusive example of structures and methods according to the present disclosure have been presented. While the present disclosure may be susceptible to various modifications and alternative forms, the exemplary embodiments discussed herein have been shown only by way of example. However, it should again be understood that the present disclosure is not intended to be limited to the particular embodiments disclosed herein. Indeed, the present disclosure includes all alternatives, modifications, and equivalents falling within the true spirit and scope of the appended claims.

What is claimed is:

1. A modular structure for protecting an offshore vessel in a body of water from forces of ice features in the body of water, the protective structure comprising:

a protective harbor wall constructed and arranged to enclose a harbor space, the harbor space being sized to receive the offshore vessel, and the protective harbor wall constructed and arranged to allow entry and exit of the offshore vessel to and from the harbor space, as well as to counteract the forces of ice features in the body of water;

a flotation support constructed and arranged to support the protective harbor wall;

a pile; and a telescoping connection operatively coupled to the protective harbor wall and the flotation support, the telescoping connection constructed and arranged to axially move the protective harbor wall between a retracted position and a raised position, wherein:

the flotation support having capacity to float and support the protective harbor wall and to change net buoyancy of the modular protective structure to submerge the modular protective structure to a submerged position where the flotation support is positioned on a seabed in the body of water and where the protective harbor wall while in the retracted position is positioned entirely below a surface of the body of water and while in the raised position includes at least a portion of the protective harbor wall extending above the surface of the body of water to establish a harbor within which the offshore vessel is protected from the forces of ice features in the body of water, and the pile constructed and arranged to be partially disposed into the seabed to maintain the position of the flotation support on the seabed;

wherein the protective harbor wall is open at the top and the bottom.

2. The modular protective structure of claim 1, wherein the protective harbor wall is a modular protective harbor wall comprising a plurality of discrete elements operatively coupled together to form the modular protective harbor wall.

3. The modular protective structure of claim 2, wherein the plurality of elements of the modular protective wall are a plurality of elongate panels that are operatively coupled together in a cylindrical form using post-cast tensioners.

4. The modular protective structure of claim 2, wherein the plurality of elements of the modular protective harbor wall are a plurality of elongate panels that are operatively coupled together in a rectangular form using post-cast tensioners.

5. The modular protective structure of claim 2, wherein the plurality of elements of the modular protective harbor wall are a plurality of precast concrete panels, the plurality of precast concrete panels operatively coupled together using a wire wrapping circumferentially disposed around the plurality of precast concrete panels and a layer of shotcrete disposed over the wire wrapping.

6. The modular protective structure of claim 2, wherein the plurality of elements of the modular protective harbor wall comprise a plurality of metallic panels.

7. The modular protective structure of claim 1, wherein the protective harbor wall is constructed and arranged to have a strength sufficient to withstand second-year ice conditions or other multi-year ice conditions such that the protective harbor wall provides a year round capacity to protect the offshore vessel within the harbor.

8. The modular protective structure of claim 1, wherein the flotation support comprises a plurality of discrete modular flotation elements.

9. The modular protective structure of claim 1, wherein the telescoping connection includes a guide wall.

10. The modular protective structure of claim 9, wherein the guide wall is a modular guide wall comprising a plurality of discrete panels operatively coupled together to form the modular guide wall which is open at the top and the bottom.

11. The modular protective structure of claim 1, wherein the telescoping connection includes a plurality of guide-posts.

12. The modular protective structure of claim 9, wherein the telescoping connection further comprises a rack and pinion unit.

13. The modular protective structure of claim 9, wherein the telescoping connection further comprises a plurality of hooks.

14. A method for extending the service of an offshore vessel in a geographical region having a season of ice conditions comprising:

establishing a harbor space protected from forces of ice features in a body of water at a location of operations by:

providing a modular protective structure at the location of operations, the modular protective structure comprising a flotation support, a protective harbor wall, a telescoping connection operatively coupled to the protective harbor wall and the flotation support, and a pile, the protective harbor wall constructed and arranged to enclose the harbor space, the harbor space being sized to receive the offshore vessel, submerging the modular protective structure to a submerged position where the flotation support is positioned on a seabed of the body of water and the entirety of the protective harbor wall while in a retracted position is positioned below a surface of the body of water, securing the flotation support to the seabed using the pile, and raising the protective harbor wall to a raised position using the telescoping connection while the flotation support remains secured to the seabed, at the raised position at least a portion of the protective harbor wall extends above the surface of the body of water to establish a harbor within which the offshore vessel is protected by the protective harbor wall from the forces of ice features in the body of water;

moving the offshore vessel into a position within the protective harbor wall proximate the location of operations; and extending operations of the offshore vessel in the season of ice conditions by maintaining the protective harbor wall in the raised position to protect the offshore vessel from ice features during the extended operations.

15. The method of claim 14, wherein the moving of the offshore vessel includes moving the offshore vessel into or out the harbor by opening and closing a gate provided on the protective harbor wall.

16. The method of claim 14, wherein the moving of the offshore vessel comprises:

moving the offshore vessel into a position proximate the location of operations and within the harbor to be formed by the protective harbor wall while the submerged protective harbor wall is in the retracted position.

17. A method for preparing a site for operations in a region having periods of ice conditions, the method comprising:

constructing a modular protective harbor wall by operatively coupling a plurality of elements together to form an annulus;

constructing a modular flotation support by:

constructing a plurality of modular flotation elements, launching the constructed plurality of modular flotation elements separately into a body of water, and while the launched plurality of modular flotation elements are in the body of water, operatively coupling together the launched plurality of modular flotation elements to form an annulus;

operatively coupling the modular protective harbor wall and the modular flotation support using a telescoping connection to create a submersible modular protective harbor structure; and moving the submersible modular protective harbor structure to the site of operations, wherein:

the annulus is sized to receive an offshore vessel, and the modular protective harbor wall is constructed and arranged to allow entry and exit of the offshore vessel to and from the annulus; and the modular protective harbor wall is open at the top and the bottom.

18. The method of claim 17, further comprising submerging the submersible protective harbor structure to a submerged position at the site of operations where the modular flotation support is positioned on a seabed of a body of water at the site of operations and the modular protective harbor wall while in a retracted position is positioned below a surface of the body of water; and securing the modular flotation support to the seabed using a pile, wherein the telescoping connection has a capacity to move the modular protective harbor wall to a raised position where at least a portion of the modular protective harbor wall extends above the surface of the body of water to establish a harbor within which the offshore vessel is protected by the modular protective harbor wall from the forces of ice features in the body of water.

* * * * *